US011332922B2

(12) United States Patent
Kochanowski

(10) Patent No.: US 11,332,922 B2
(45) Date of Patent: May 17, 2022

(54) JOINTED MEMBER

(71) Applicant: George E. Kochanowski, Springboro, OH (US)

(72) Inventor: George E. Kochanowski, Springboro, OH (US)

( * ) Notice: Subject to any disclaimer, the term of this patent is extended or adjusted under 35 U.S.C. 154(b) by 22 days.

(21) Appl. No.: 16/742,090

(22) Filed: Jan. 14, 2020

(65) Prior Publication Data

US 2020/0149267 A1 May 14, 2020

Related U.S. Application Data

(63) Continuation of application No. 14/239,041, filed as application No. PCT/US2012/050676 on Aug. 14, 2012, now Pat. No. 10,533,313.
(Continued)

(51) Int. Cl.
*E04B 1/344* (2006.01)
*B65D 88/52* (2006.01)

(52) U.S. Cl.
CPC ..... *E04B 1/3441* (2013.01); *B65D 88/522* (2013.01); *Y10T 403/32073* (2015.01)

(58) Field of Classification Search
CPC .... B65D 88/52; B65D 88/522; B65D 88/524; B65D 88/526; B65D 90/02; E04B 1/343; E04B 1/344; E04B 1/3441; E21D 15/22; F16C 11/10; F16M 11/10; F16M 11/04; Y10T 403/11; Y10T 403/32073; Y10T 403/32319; Y10T 403/32434; Y10T 403/32442; Y10T 403/32451; Y10T 403/32459; Y10T 403/32581; Y10T 403/32861; Y10T 403/32868; Y10T 403/32919
(Continued)

(56) References Cited

U.S. PATENT DOCUMENTS 1,377,382 A 5/1921 Wyman
1,609,259 A 11/1926 Macnider et al.
(Continued)

FOREIGN PATENT DOCUMENTS

DE 10141791 3/2003
DE 202009004012 9/2010
(Continued)

OTHER PUBLICATIONS

"Perpendicular and Parallel." Math is Fun. [online], [retrieved on Oct. 13, 2021], Retrieved from the Internet <URL: https://www.mathsisfun.com/perpendicular-parallel.html>.*
(Continued)

*Primary Examiner* — Josh Skroupa
(74) *Attorney, Agent, or Firm* — Brooks, Cameron & Huebsch, PLLC

(57) ABSTRACT

A jointed member may include a first elongate section having a surface defining a first oblong opening, a second elongate section having a surface defining a second oblong opening, and a fastener passing through the first oblong opening and the second opening to connect the first elongate section and the second elongate section, where the first oblong opening and the second oblong opening move relative each other and the fastener as the jointed member transitions from a first predetermined state towards a second predetermined state.

7 Claims, 22 Drawing Sheets

Related U.S. Application Data

(60) Provisional application No. 61/575,200, filed on Aug. 15, 2011.

(58) Field of Classification Search
USPC ..... 403/61, 91, 105–108, 116, 151; 52/71, 52/645, 646
See application file for complete search history.

(56) References Cited

U.S. PATENT DOCUMENTS

| | | | |
|---|---|---|---|
| 1,677,796 | A | 7/1928 | Dane |
| 1,686,222 | A | 10/1928 | Adler |
| 2,142,305 | A | 1/1939 | Davis |
| 2,232,346 | A | 2/1941 | Sikes |
| 2,361,743 | A | 10/1944 | Butler |
| 2,741,391 | A | 4/1956 | Belanger |
| 2,761,581 | A | 9/1956 | Cohee |
| 2,868,407 | A | 1/1959 | Woodcock |
| 3,004,682 | A | 10/1961 | Bertolini et al. |
| 3,078,957 | A | 2/1963 | Larson |
| 3,128,897 | A | 4/1964 | Wilkins |
| 3,398,850 | A | 8/1968 | Kennard |
| 3,403,806 | A | 10/1968 | Pohl |
| 3,410,328 | A | 11/1968 | Sasai |
| 3,480,174 | A | 11/1969 | Sherwood |
| 3,535,845 | A | 10/1970 | Troutner |
| 3,570,698 | A | 3/1971 | Dougherty |
| 3,612,330 | A | 10/1971 | Baer |
| 3,612,338 | A | 10/1971 | Ekman |
| 3,684,122 | A | 8/1972 | Bonomi |
| 3,752,349 | A | 8/1973 | Rana |
| 3,765,556 | A | 10/1973 | Baer |
| 3,785,108 | A | 1/1974 | Satchell |
| 3,907,147 | A | 9/1975 | Goobeck |
| 3,937,363 | A | 2/1976 | Anderson |
| 4,030,378 | A | 6/1977 | Kroesser |
| 4,112,635 | A | 9/1978 | Rylander |
| 4,122,638 | A | 10/1978 | O'Brian et al. |
| 4,191,419 | A | 3/1980 | Kirkpatrick |
| 4,214,669 | A | 7/1980 | McQuiston |
| 4,457,569 | A | 7/1984 | Scheerhorn |
| 4,560,129 | A | 12/1985 | Clayton |
| 4,577,772 | A | 3/1986 | Bigliardi |
| 4,726,486 | A | 2/1988 | Masuda |
| 4,793,507 | A | 12/1988 | Delplanque |
| 5,107,639 | A | 4/1992 | Morin et al. |
| 5,190,179 | A | 3/1993 | Richter et al. |
| 5,257,830 | A | 11/1993 | Pflueger |
| 5,501,353 | A | 3/1996 | Warren |
| 5,878,903 | A | 3/1999 | Ung |
| 5,890,339 | A | 4/1999 | Willis |
| 5,890,612 | A | 4/1999 | Coppi |
| 6,032,815 | A | 3/2000 | Elstone |
| 6,108,982 | A | 8/2000 | Davison |
| 6,109,469 | A | 8/2000 | Clive-Smith |
| 6,112,929 | A | 9/2000 | Ota |
| 6,164,476 | A | 12/2000 | Rene et al. |
| 6,182,849 | B1 | 2/2001 | Elstone, Sr. |
| 6,299,009 | B1 | 10/2001 | Ryziuk et al. |
| 6,357,194 | B1 | 3/2002 | Jones, Jr. |
| 6,401,422 | B1 | 6/2002 | Olden |
| 6,565,056 | B2 * | 5/2003 | Lin ..... A47B 21/0314 108/138 |
| 7,296,704 | B2 | 11/2007 | Ferrini |
| 7,341,392 | B2 | 3/2008 | Yeh |
| 7,641,163 | B2 * | 1/2010 | O'Keene ..... F16M 11/10 248/292.14 |
| 7,703,632 | B2 | 4/2010 | Kochanowski |
| 8,245,479 | B2 | 8/2012 | Gannon et al. |
| 8,850,774 | B2 * | 10/2014 | Kempf ..... E04B 1/2403 52/640 |
| 2004/0231277 | A1 | 11/2004 | Rosskamp |
| 2004/0247378 | A1 | 12/2004 | Sarkisian |
| 2006/0016807 | A1 | 1/2006 | Hsu et al. |
| 2008/0029508 | A1 | 2/2008 | Kochanowski |
| 2010/0089917 | A1 | 4/2010 | Gilbert et al. |
| 2010/0292063 | A1 | 11/2010 | Chawia et al. |

FOREIGN PATENT DOCUMENTS

| | | |
|---|---|---|
| EP | 0832825 | 4/1998 |
| EP | 1702864 | 9/2006 |
| GB | 2450676 | 1/2009 |
| JP | 05-010240 | 2/1993 |
| JP | 2002160793 | 6/2002 |
| JP | 2002264993 | 9/2002 |
| TW | M262477 | 4/2005 |
| WO | 9928215 | 6/1999 |
| WO | 2006024104 | 3/2006 |

OTHER PUBLICATIONS

Priyo, "Maximizing Space," Innovation, Issue 10, Sep. 2008, 7 pp.
International Search Report and Written Opinion for related PCT Application PCT/US2012/050676, dated Nov. 23, 2012 (18 pgs).

* cited by examiner

JOINTED MEMBER

This application is a continuation of U.S. National Stage application Ser. No. 14/239,041 filed Feb. 14, 2014 and published as 2014/0212203 on Jul. 31, 2014 and will issue as U.S. Pat. No. 10,533,313 on Jan. 14, 2020, which claims priority to International Application No. PCT/US2012/050676, filed Aug. 14, 2012 and published as WO 2013/025663 on Feb. 21, 2013, which claims the benefit under 35 U.S.C. § 119(e) of U.S. Provisional Patent Application No. 61/575,200, filed Aug. 15, 2011, which is incorporated herein by reference in its entirety.

FIELD OF DISCLOSURE

Embodiments of the present disclosure are directed to a jointed member; more specifically, a jointed member useful in reversibly foldable structures.

BACKGROUND

Freight containers are used for transferring goods from one location to another location. Freight containers may be transferred via a number of different modes such as, overseas transfer, rail transfer, air transfer, and tractor trailer transfer.

To help improve efficiencies freight containers that are used to transfer goods have been standardized. One such standardization is overseen by the International Organization for Standardization, which may be referred to as "ISO." The ISO publishes and maintains standards for freight containers. These ISO standards for freight containers help provide that each freight container has similar physical properties. Examples of these physical properties include, but are not limited to, width, height, depth, base, maximum load, and shape of the cargo containers.

SUMMARY

The present disclosure provides a jointed member, a reversibly foldable structure that includes the jointed member and a reversibly foldable freight container that includes the jointed member.

The joined member comprises a first elongate section having a first surface defining a first oblong opening. The first elongate section can also include a first abutment member and a first member end opposite the first abutment member. The jointed member also includes a second elongate section having a second surface defining a second oblong opening. The second elongate section can also include a second abutment member and a second member end opposite the second abutment member.

The jointed member includes a fastener passing through the first oblong opening and the second oblong opening to connect the first elongate section and the second elongate section. The first oblong opening and the second oblong opening move relative each other and the fastener as the jointed member transitions from a first predetermined state towards a second predetermined state. The first oblong opening and the second oblong opening move relative each other and the fastener as the jointed member transitions from a first predetermined state having a minimum overlap of the first oblong opening and the second oblong opening towards a second predetermined state having a maximum overlap of the first oblong opening and the second oblong opening relative the minimum overlap. The first oblong opening and the second oblong opening can have an obround shape.

The first elongate section can include a first abutment member and the second elongate section includes a second abutment member, where in the first predetermined state the first abutment member and the second abutment member can be in physical contact while a portion of the first surface defining the first oblong opening and a portion of the second surface defining the second oblong opening are in physical contact with the fastener. For example, in the first predetermined state the first abutment member and the second abutment member can be under a compressive force while a portion of the first surface defining the first oblong opening and a portion of the second surface defining the second oblong opening can apply a shearing stress to the fastener. Each of the first surface and the second surface includes a first end and a second end opposite the first end, where the shearing stress in the first predetermined state can be applied by the first end of both the first surface and the second surface. In an embodiment, each of the first end and the second end are in the shape of an arc, where the first end of the first oblong opening and the second oblong opening form a circular shape when in the first predetermined state.

The first abutment member and the second abutment member can define a first point of rotation around a first axis of rotation for the first elongate section and the second elongate section, and the second end of both the first surface and the second surface, when positioned against the fastener, define a second point of rotation around a second axis of rotation for the first abutment member and the second abutment member that is different than the first point of rotation. The first elongate section and the second elongate section can turn on the first point of rotation prior to turning on the second point of rotation as the jointed member transitions from the first predetermined state towards the second predetermined state. The first end of each of the first surface and the second surface does not contact the fastener when the second end of both the first surface and the second surface are seated against the fastener.

The first elongate section can include a first member end opposite the first abutment member and the second elongate section includes a second member end opposite the second abutment member, where in the first predetermined state a distance between the first member end of the first elongate section and the second member end of the second elongate section provides a defined maximum length of the jointed member. The distance between the first member end of the first elongate section and the second member end of the second elongate section does not exceed the defined maximum length as the jointed member transitions from the first predetermined state towards the second predetermined state.

In the first predetermined state, the fastener, the first abutment member and the first member end, all in a common plane, define a right triangle of the first elongate section, where a hypotenuse of the right triangle is between the fastener and the first member end, and a first leg of the right triangle is defined by the first member end and a perpendicular intersection of a first line extending from the first member end and a second line extending from a geometric center of the fastener, where the first and second lines are in the common plane. In the first predetermined state the fastener, the second abutment member and the second member end, all in a common plane, define a right triangle of the second elongate section, where a hypotenuse of the right triangle is between the fastener and the second member end, and a first leg of the right triangle is defined by the second member end and a perpendicular intersection of a first line extending from the second member end and a second line extending from a geometric center of the fastener, where the first and second lines are in the common plane. In the first predetermined state the hypotenuse has a length that is greater than a length of the first leg.

As the first abutment member and the second abutment member rotate about the second point of rotation a length between the fastener and the first member end, both in the common plane, is no greater than the length of the first leg of the right triangle of the first elongate section. As the first abutment member and the second abutment member rotate about the second point of rotation a length between the fastener and the second member end, both in the common plane, is no greater than the length of the first leg of the right triangle of the second elongate section.

In one embodiment, the fastener is free to move along a longitudinal axis of the first oblong opening and the second oblong when the first oblong opening and the second oblong opening are in the second predetermined state. The fastener is not free to move along the longitudinal axis of the first oblong opening and the second oblong when the first oblong opening and the second oblong opening are in the first predetermined state. The longitudinal axis of the first oblong opening and the longitudinal axis of the first elongate section can form a first angle that can have a value from 0 degrees to 45 degrees. The longitudinal axis of the second oblong opening and the longitudinal axis of the second elongate section can form a second angle that can have a value from 0 degrees to 45 degrees.

In one or more embodiments, the first elongate section can include a third abutment member such that that the third abutment member and the second abutment member abut when the jointed member is in the second predetermined state.

The present disclosure also includes a reversibly foldable structure that includes a first longitudinal member; a second longitudinal member; and a jointed member located between the first longitudinal member and the second longitudinal member. As discussed herein, the jointed member includes a first elongate section having a surface defining a first oblong opening, a second elongate section having a surface defining a second oblong opening, and a fastener passing through the first oblong opening and the second opening to connect the first elongate section and the second elongate section. The first oblong opening and the second oblong opening move relative each other and the fastener as the jointed member transitions from a first predetermined state having a minimum overlap of the first oblong opening and the second oblong opening towards a second predetermined state having a maximum overlap of the first oblong opening and the second oblong opening. As provided herein, a distance between the first member end of the first elongate section and the second member end of the second elongate section provides a defined maximum length of the jointed member, where the distance between the first member end of the first elongate section and the second member end of the second elongate section does not exceed the defined maximum length as the jointed member transitions from the first predetermined state towards the second predetermined state. In the first predetermined state the first elongate section abuts the first longitudinal member and the second elongate section abuts the second longitudinal member.

In one embodiment, the reversibly foldable structure can include a first vertical support member, a second vertical support member, a third vertical support member, and a fourth vertical support member, the first longitudinal member located between the first vertical support member and the second vertical support member, and the second longitudinal member located between the third vertical support member and the fourth vertical support member.

The above summary of the present disclosure is not intended to describe each disclosed embodiment or every implementation of the present disclosure. The description that follows more particularly exemplifies illustrative embodiments. In several places throughout the application, guidance is provided through lists of examples, which examples can be used in various combinations. In each instance, the recited list serves only as a representative group and should not be interpreted as an exclusive list.

BRIEF DESCRIPTION OF THE FIGURES

FIGS. 8A-1, 8A-2, 8B and 8C illustrate a portion of the jointed member according to the present disclosure.

DETAILED DESCRIPTION

Figure 1A:
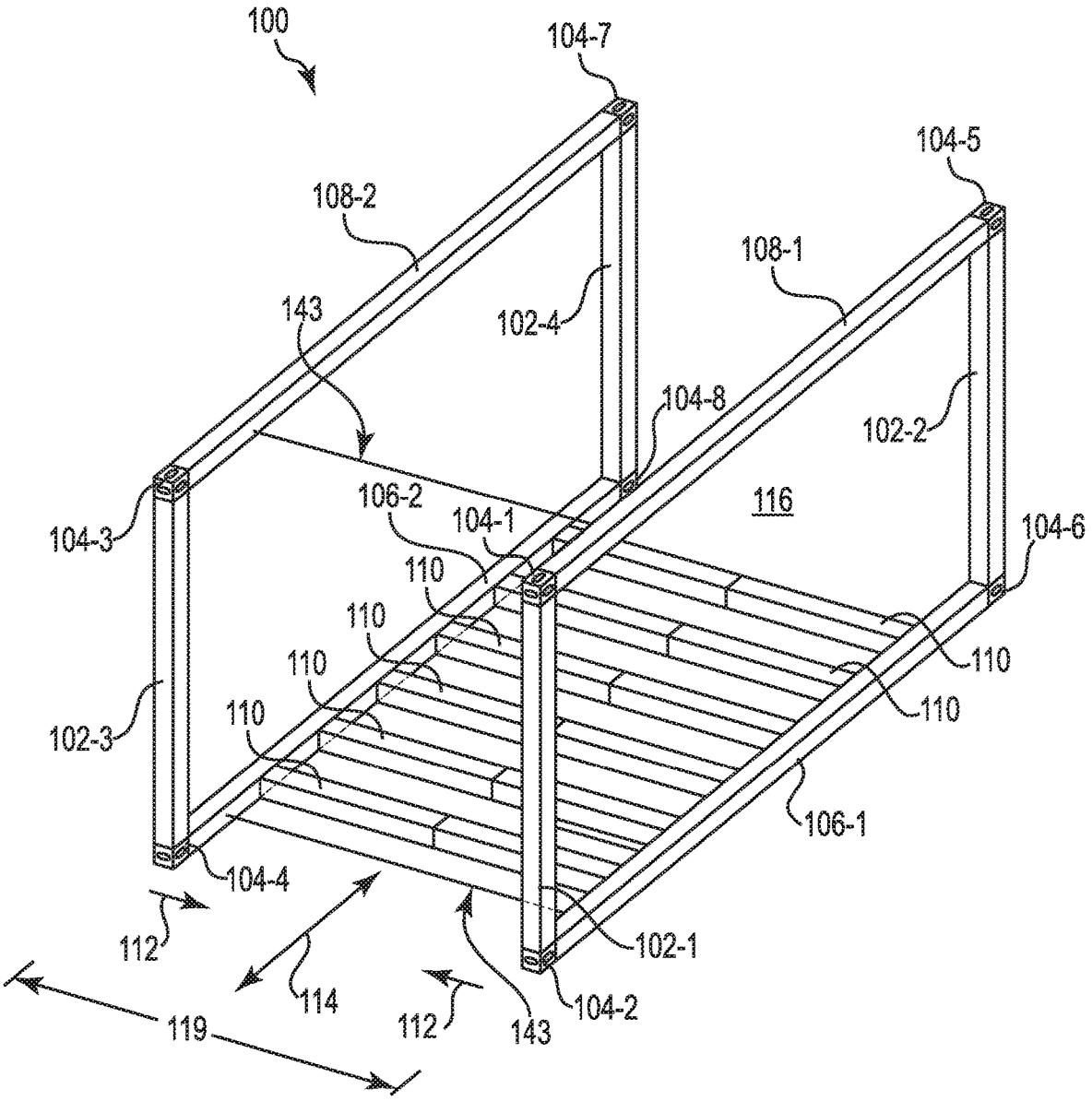
FIGS. 1A-1B illustrate a reversibly foldable freight container, from which portions have been removed, according to the present disclosure.

As used herein, "a," "an," "the," "at least one," and "one or more" are used interchangeably. The term "and/or" means one, one or more, or all of the listed items. The recitations of numerical ranges by endpoints include all numbers subsumed within that range (e.g., 1 to 5 includes 1, 1.5, 2, 2.75, 3, 3.80, 4, 5, etc.).

The figures herein follow a numbering convention in which the first digit or digits correspond to the drawing figure number and the remaining digits identify an element in the drawing. Similar elements between different figures may be identified by the use of similar digits. For example, 354 may reference element "54" in FIG. 3, and a similar element may be referenced as 454 in FIG. 4. It is emphasized that the purpose of the figures is to illustrate and the figures are not intended to be limiting in any way. The figures herein may not be to scale and relationships of elements in the figures may be exaggerated. The figures are employed to illustrate conceptual structures and methods herein described.

Freight containers (also known as containers, shipping containers, intermodal containers and/or ISO containers, among other names) can be transported by rail, air, road and/or water. Freight containers are often times transported empty. Because the freight container occupies the same volume whether it contains goods or not, the cost (both financial and environmental) to transport an empty freight container can be equivalent to the cost of transporting a full freight container. For example, the same number of trucks (e.g., five) would be needed to transport the same number of empty freight containers (e.g., five). In addition, freight containers often times sit empty at storage facilities and/or transportation hubs. Regardless of where the freight container is located (in transit or in storage) the volume an empty freight container occupies is not being used to its full potential.

One solution to these issues would be a reversibly foldable freight container, as is discussed herein. Having a reversibly foldable freight container would allow for an "empty" freight container to be folded to achieve a volume that is smaller than its fully expanded state. This extra volume acquired by at least partially folding the freight container could then be used to accommodate other at least partially folded freight containers, provide additional volume for non-foldable (e.g., regular) freight containers and/or foldable freight containers in their fully expanded state. So, for example, a number of reversibly foldable freight containers that are empty (e.g., five) could be folded and nested in such a way that one truck could transport the number of empty freight containers. As a result the environmental and cost savings are expected to be significant.

As will be more fully discussed herein, the jointed member of the present disclosure has applications for structures (e.g., freight containers, foldable structures such as folding arrays of solar panels used in space flight, solid seat wheelchairs, and hydraulic lifts) that include a beam, or beams, as a part of the structure. As used herein, a beam is a structural element that is capable of withstanding a load primarily by resisting bending. The joined member of the present disclosure can be configured as a beam, or as part of a beam, for such structures. In addition to acting as a beam, however, the joined member of the present disclosure also allows for the structure to fold. When in a folded state, the structure occupies a volume that is less than that of the structure in an unfolded state. So, when in the folded state the structure occupies a volume and/or an area that is less than that of the structure in an unfolded state.

Another significant advantage of the jointed member of the present disclosure is its surprising ability to fold within a defined maximum length of the jointed member (e.g., the defined maximum length can be a maximum length of the jointed member). For the various embodiments, this defined maximum length of the jointed member can be the defined maximum length of the jointed member in an unfolded state. So, the jointed member of the present disclosure can transition from an unfolded state to a folded state without causing any portion of the jointed member (e.g., the ends of the joined member that help define the defined maximum length) to extend beyond its defined maximum length. The following discussion will help to further clarify the problem that the jointed member of the present disclosure has helped to overcome.

Figure 1B:
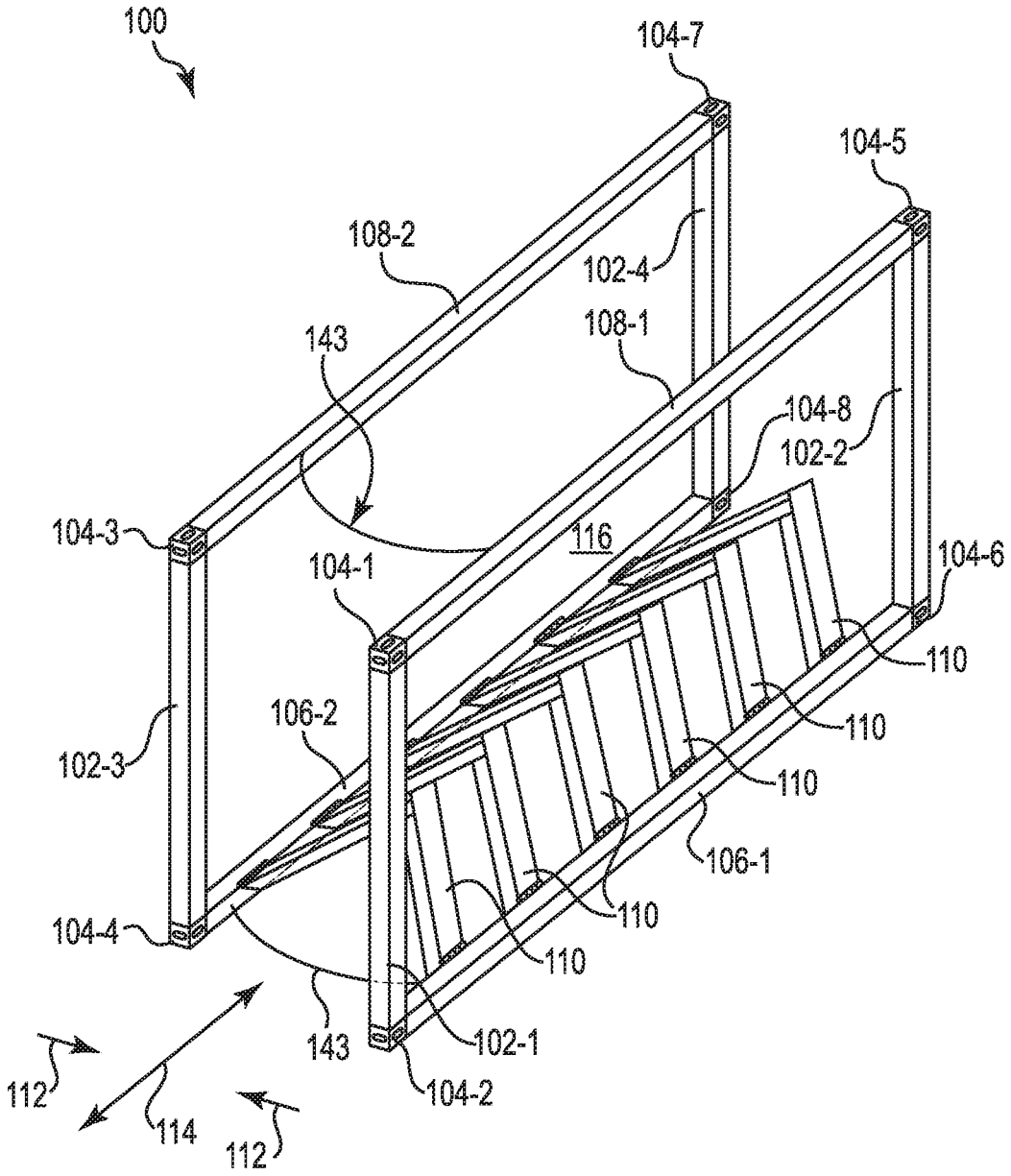

FIGS. 1A and 1B illustrate a reversibly foldable freight container 100 according to one or more embodiments of the present disclosure. In FIGS. 1A and 1B portions of the reversibly foldable freight container 100 have been removed (e.g., portions of the roof structure, portions of the sidewall structure, portions of the floor structure, portions of the end frame, portions of the door assembly, etc.) to allow the location and relative position of the jointed member of the present disclosure, which in this embodiment acts as a cross member of the reversibly foldable freight container 100, to be more clearly seen. The reversibly foldable freight container 100 illustrated in FIG. 1A is shown in an unfolded state.

As illustrated in FIG. 1A, the reversibly foldable freight container 100 includes a first corner post 102-1, a second corner post 102-2, a third corner post 102-3, and a fourth corner post 102-4. For one or more embodiments, the corner posts 102-1 through 102-4 are load bearing vertical support members that are both rigid and unfoldable. In addition, the corner posts 102-1 through 102-4 are of sufficient strength to support the weight of a number of other fully loaded freight containers stacked upon the reversibly foldable freight container 100. For one or more embodiments, each of the corner posts 102-1 through 102-4 includes a corner fitting 104-1 through 104-8. The corner fittings 104-1 through 104-8 may be employed for griping, moving, placing, and/or securing the reversibly foldable freight container 100. In one embodiment, the corner posts 102-1 through 102-4 and the corner fittings 104-1 through 104-8 comply with the ISO standards for freight containers, such as ISO standard 688 and ISO standard 1496 (and the amendments to ISO standard 1496), among others.

The reversibly foldable freight container 100 also includes a first bottom side rail 106-1 and a second bottom side rail 106-2. As illustrated, the first bottom side rail 106-1 is located between the first corner post 102-1 and the second corner post 102-2, and the second bottom side rail 106-2 is located between the third corner post 102-3 and the fourth corner post 102-4. The reversibly foldable freight container 100 further includes a first upper side rail 108-1 and a second upper side rail 108-2. The first upper side rail 108-1 may be located between the first corner post 102-1 and the second corner post 102-2. The second upper side rail 108-2 may be located between the third corner post 102-3 and the fourth corner post 102-4.

The reversibly foldable freight container 100 further includes a jointed member 110 according to the present disclosure. As illustrated, the first and second bottom side rails 106-1 and 106-2 are joined by two or more of the jointed members 110. For the various embodiments, the jointed member 110 acts as a "cross member" in the reversibly foldable freight container 100 when the foldable freight container 100 is in an unfolded state. Functioning as a cross member, the jointed member 110 acts as a beam to carry a structural load placed on a floor structure of the reversibly foldable freight container 100. To this end, the joined member 110 of the present disclosure can help in carrying a structural load as prescribed in ISO standard 1496. Unlike a typical cross member, however, the joined member 110 of the present disclosure can then be used to help the reversibly foldable freight container 100 to reversibly fold in a lateral direction 112, relative a longitudinal direction 114 of the upper and bottom side rails 106 and 108.

Referring now to FIG. 1B, there is shown the reversibly foldable freight container 100 in at least a partially folded state. As illustrated in FIG. 1B, the jointed member 110 of the reversibly foldable freight container 100 folds into a volume 116 defined by the container 100. As the jointed member 110 folds, the corner posts 102-1 through 102-4 and the corner fittings 104-1 through 104-8 are drawn closer together laterally. Once again, this reduction in the volume 116 and the "foot-print" (e.g., area) of the reversibly foldable freight container 100 from an unfolded state (e.g. FIG. 1A) can be accomplished, as least in part, due to the presence of the jointed members 110.

As discussed more fully herein, one major obstacle overcome by the joined member 110 of the present disclosure is its ability to not only act as a structural member or beam capable of supporting a load, such as a load as prescribed in ISO standard 1496, when in an unfolded state, but also its surprising ability to transition towards a folded state without having any portion of the jointed member 110 extending beyond its defined maximum length 119 as defined in an unfolded state. The importance of this issue is presented as follows.

Figure 2:
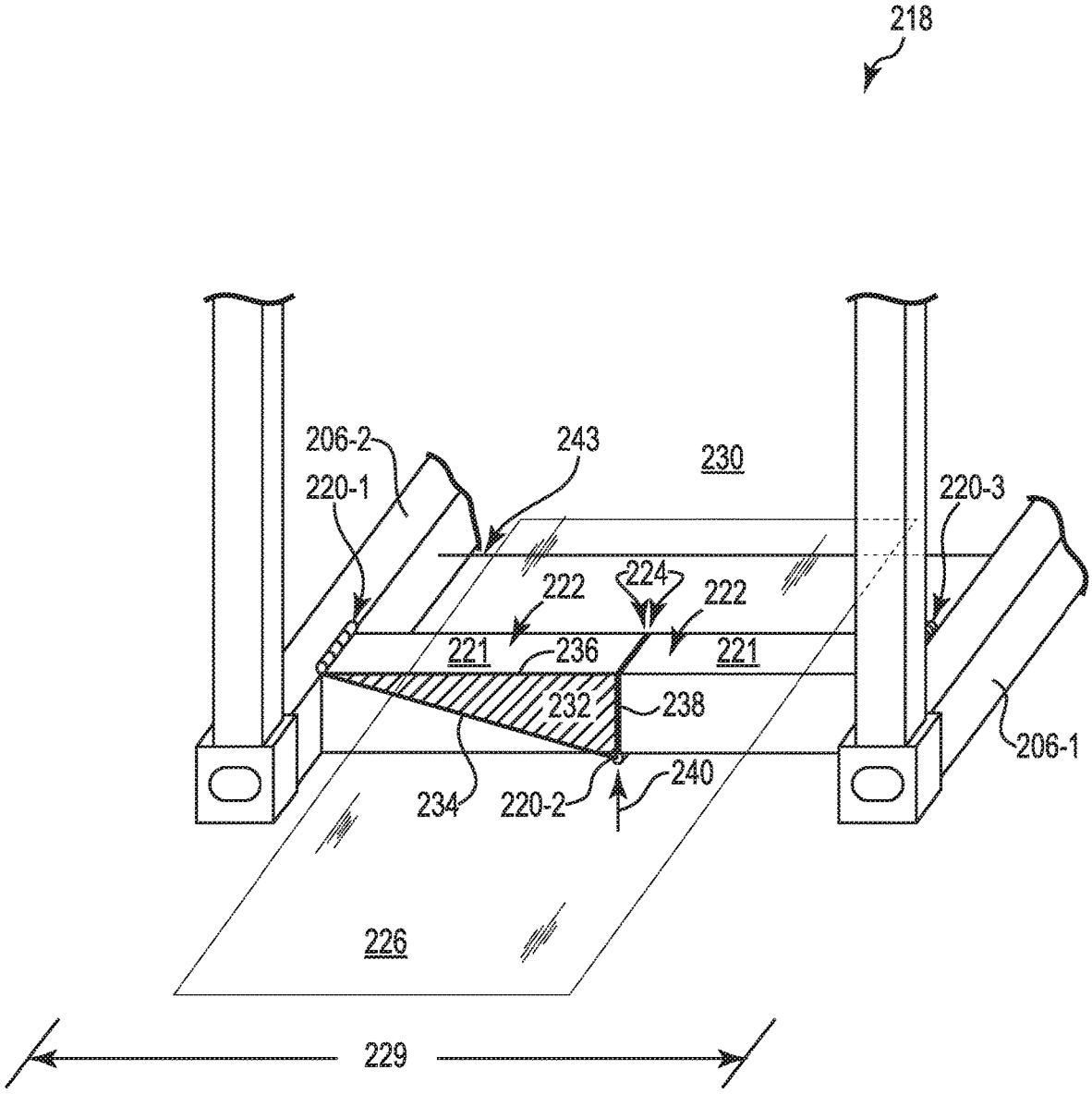
FIG. 2 illustrates an end view of a freight container shown in partial view.

Referring to FIG. 2, there is shown an end view of a freight container 218. The freight container 218 is shown in a partial view, where portions of the floor structure (e.g., the wood flooring), sidewall structure, end frame and door assembly have been removed to better illustrate the issues encountered with trying to fold the freight container 218. The freight container 218 does not include the jointed member of the present disclosure, but rather is shown with hinges 220-1 through 220-3 that connect two portions (e.g., halves) of a cross member 222. Conventional thinking would dictate that the hinges 220-1 through 220-3 should act as a bearing that not only connects the halves of the cross members 222 together and to the bottom side rails 206-1 and 206-2 of the freight container 218, but also allows for the cross member 222 to fold into a volume 230 of the freight container 218.

The cross members 222 can have a variety of cross sectional shapes. Such cross-sectional shapes can include box (e.g. rectangular or square), C-channel, Z-beam and I-beam cross sectional shapes. As illustrated, these cross-sectional shapes allow for surfaces 224 of the cross members 222 that abut each other when in the unfolded state. When abutted, the surfaces 224 of cross-member 222 come under compression, with help from the hinge 220-1 to prevent the upper surface 221 of the cross-member 222 from extending below a plane 226 when a structural load is placed on the floor of the freight container 218. The plane 226 is an imaginary flat surface on which a straight line joining any two points would wholly lie. So, in the present embodiment, any two points on the upper surface 221 of the cross-member 222 would lie in the plane 226.

As illustrated, the placement of the hinges 220-1 through 220-3 would appear to allow for the floor structure of the freight container 218 to fold within a maximum defined width 229. This, however, is not the case. Significant issues arise during the folding of the freight container 218. These issues are significant enough that the structural integrity of the freight container 218 may be compromised as the cross member 222 begins to fold using hinges 220-1 through 220-3. Once compromised, the freight container 218 may no longer be compliant with ISO standards. In addition, the freight container 218 may also longer be capable of supporting loads and/or be structurally viable.

As illustrated, the cross member 222 of the freight container 218 is in the unfolded state and has a maximum defined width 229. Also illustrated in freight container 218 are three hinges 220-1 through 220-3 which appear to allow for the cross member 222 of the freight container 218 to fold up into the volume 230 defined by the freight container 218. Examining the relative location of the three hinges 220-1 through 220-3 the corners of a right triangle 232 (shown with shading) are present. The right triangle 232 includes a hypotenuse 234 that is longer than either of a first leg 236 or a second leg 238 of the right triangle 232. As appreciated, the greater the length of the second leg 238 the longer the hypotenuse 234.

It can also be seen that in the unfolded state the length of two of the first legs 236 helps to define the maximum defined width 229 of the freight container 218. Now, as the freight container 218 begins to fold from an unfolded state the width of the freight container 218 will have to become greater than the maximum defined width 229 to accommodate the length of the hypotenuse 234. So, if the cross member 222 were to move along the direction of travel 240 there would not be enough width available for the two portions that makes up the cross member 222 to move from or return to the unfolded state (e.g., the condition where the floor of the freight container 218 is parallel with the plane 226). This issue is referred to herein as "the hypotenuse issue."

If the two portions that makes up the cross member 222 were to be forced to move along the direction of travel 240 at least one of following may happen: (1) the overall width of the freight container 218 will have to increase beyond its maximum defined width 229; (2) the portions that make up the cross member 222 will have to bend or deform (elastically or non-elastically); and/or (3) the first, second and/or third hinge 220-1, 220-2, 220-3 will deform and/or break. The issues become more apparent when a structure 243 is used with the freight container 218, such as a roof structure and/or a lateral bracing member, each having a fixed length and/or width that cannot, or should not, be extended beyond the maximum defined width 229 of the freight container 218. Examples of such lateral bracing members can includes, but are not limited to, cables, structural beams, rods and/or tubes that can be used to help brace and support the freight container 218 in an unfolded state. As will be appreciated, one or more of these structures (e.g., the roof structure, a lateral bracing member, one or more of the hinges, and/or the cross member 222, among other structures) could be damaged as the freight container 218 folds from an unfolded state.

Regardless of what does happen one thing is almost certain, due to the hypotenuse issue discussed herein expanding the freight container 218 beyond its maximum defined width 229 may result in weakening of the freight container 218 (e.g., the hinges 220-1 through 220-3, the cross member 222 and/or the structure 243) such that it would no longer be able to support a load, e.g. no longer be in compliance with the ISO standards, thus rendering the freight container 218 unfit for its intended purpose. Therefore, when transitioning a container from an unfolded state to a folded state it may be desirable to provide that the width of the container does not expand beyond its maximum defined width 229 in the unfolded state.

The joined member of the present disclosure overcomes the hypotenuse issue discussed herein. The jointed member, as disclosed herein, may help provide that a container, such as the reversibly foldable freight container 100 can transition from an unfolded state to a folded state without expanding the maximum defined width of the container beyond the unfolded state. All this can be accomplished while neither bowing the jointed member nor damaging a pivotal connection (e.g., hinges) of the reversibly foldable freight container 100.

In addition, when a structure 143 is used with the reversibly foldable freight container 100 (e.g., such as a roof structure and/or a lateral bracing member), the jointed member 110 allows the reversibly foldable freight container 100 to reversibly fold within a fixed length and/or width of the structure 143. Examples of such structures 143 can include, but are not limited to, cables, structural beams, rods and/or tubes that can be used to help brace and support the reversibly foldable freight container 100 in an unfolded state. As will be understood reading the present disclosure these structures (e.g., the roof structure, a lateral bracing member, one or more of the hinges, and/or the jointed member 110, among other structures) will not be damaged as the reversibly foldable freight container 100 folds from an unfolded state.

As discussed herein, the jointed member is configured in such a way that during the folding process the length of the hypotenuse changes (e.g., is accommodated) thereby preventing damage to the jointed member, associated hinges and structures (e.g., 143). From the folded state the reversibly foldable freight container may transition back to the unfolded state, and is thus reversibly foldable.

Figure 3:
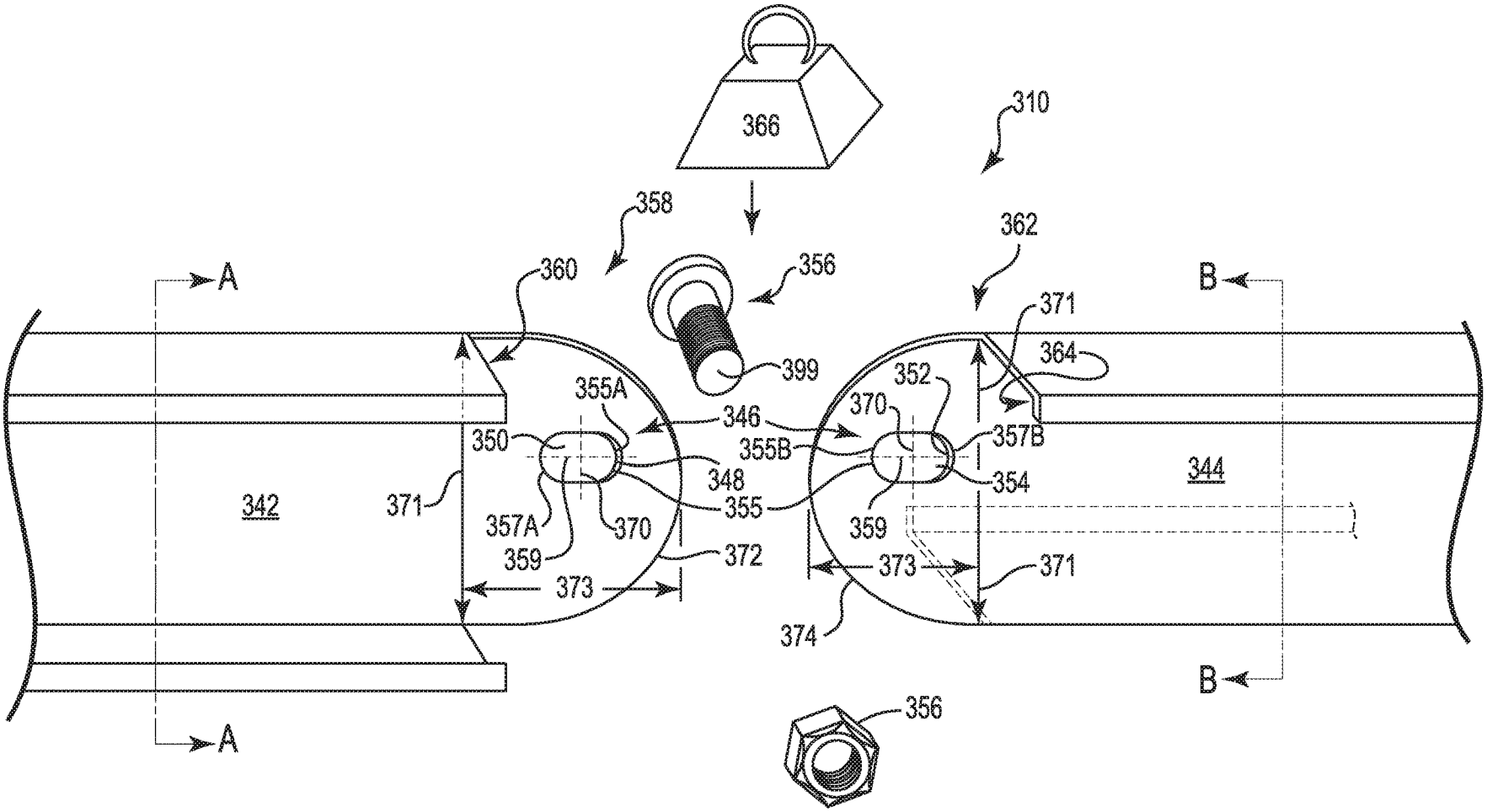
FIG. 3 illustrates an exploded view of a jointed member according to the present disclosure.

Referring now to FIG. 3, there is illustrated, in an exploded view, the jointed member 310 of the present disclosure. As illustrated, the jointed member 310 includes a first elongate section 342 and a second elongate section 344. Each of the first elongate section 342 and the second elongate section 344 can have a length that is equal. Alternatively, one of the first elongate section 342 or the second elongate section 344 can be longer than the other elongate section.

In one or more embodiments, each of the first elongate section 342 and the second elongate section 344 has an oblong opening 346. As discussed herein, an oblong opening, such as 346 among the others discussed herein, can have an obround shape or a double D shape. As such, the word oblong, as used herein, can be replaced with either the word "obround" or "double D" as so desired. Obround is defined as consisting of two semicircles connected by parallel lines tangent to their end points. Double D is defined as consisting of two arcs connected by parallel lines tangent to their end points. As used herein, an obround or double D shape does not include a circular shape.

As illustrated, the first elongate section 342 has a first surface 348 defining a first oblong opening 350 through the first elongate section 342, and the second elongate section 344 has a second surface 352 defining a second oblong opening 354 through the second elongate section 344. As illustrated, each of the surfaces 348 and 352 has a first end 355 (marked as 355-A for the first oblong opening 350, and marked as 355-B for the second oblong opening 354) and a second end 357 (marked as 357-A for the first oblong opening 350, and marked as 357-B for the second oblong opening 354), where the second end 357 is opposite the first end 355 along a longitudinal axis 359 of each of the first oblong opening 350 and the second oblong opening 354.

The joined member 310 also includes a fastener 356, a portion of which passes through the first and second oblong opening 350 and 354. As will be discussed more fully herein, the fastener 356 may pass through the first oblong opening 350 and the second oblong opening 354. The fastener 356 is then secured in position to help hold the first elongate section 342 and the second elongate section 344 together (e.g., the fastener 356 mechanically joins the first elongate section 342 and the second elongate section 344).

While the fastener 356 mechanically joins the first elongate section 342 and the second elongate section 344, the first elongate section 342 and the second elongate section 344 are also able to slide relative to each other and to rotate about the fastener 356. This ability of the first elongate section 342 and the second elongate section 344 to slide relative each other allows for a change in the length of the hypotenuse as the jointed member 310 folds, thereby preventing damage to the jointed member, associated hinges and structures, as discussed herein. This ability to both slide relative each other and to rotate about the fastener 356 provides at least two of the features that allow the jointed member 310 to overcome the hypotenuse issue. This aspect of the invention will be discussed more fully herein.

The use of a variety of fastener 356 is possible. For example, the fastener 356 can be in the form of a bolt or a rivet. The bolt can have a threaded portion at or adjacent a first end for receiving a nut and a head at a second end opposite the first end. The nut and the head of the bolt can have a diameter relative the first oblong opening 350 and the second oblong opening 354 that prevents either from passing through the openings 350 and 354 (e.g., only the body of the bolt passes through the openings 350 and 354). A washer can also be used between the head and nut of the bolt to help prevent either from passing through the openings 350 and 354.

Examples of bolts can include, but are not limited to, structural bolts, hex bolts, or carriage bolts, among others. The nut used with the bolt can be a locknut, castellated nut, a slotted nut, a distorted thread locknut, an interfering thread nut, or a split beam nut, among others. A jam nut can also be used with the nut if desired. Examples of a rivet include a solid rivet having a shaft that can pass through and a head that does not pass through the openings 350 and 354. A shop head can then be formed on the rivet that fastens the first elongate section 342 and the second elongate section 344. Regardless of which fastener is used, however, the fastener 356 is not tightened so much as to prevent the first elongate section 342 and the second elongate section 344 of the jointed member 310 from sliding relative to each other and rotating about the fastener 356.

As discussed herein, the fastener 356 passes through the first oblong opening 350 and the second oblong opening 354 to connect the first elongate section 342 and the second elongate section 344. For the various embodiments, the first oblong opening 350 and the second oblong opening 354 move relative each other and relative the fastener 356 as the jointed member 310 transitions from a first predetermined state to a second predetermined state. For the present disclosure, the first predetermined state can be the unfolded state of the jointed member 310. In the unfolded state the jointed member 310 can only move towards its folded state.

As illustrated herein, the fastener 356 has an axial center 399 (e.g., a longitudinal axis around which the fastener 356 can rotate) that moves along (e.g., essentially parallel with) the longitudinal axis 359 of the first oblong opening 350 and the second oblong opening 354 as the jointed member 310 transitions from a first predetermined state to a second predetermined state. The cross-sectional shape of the fastener 356 is of a size and a shape that allows the fastener 356 to travel along the longitudinal axis 359 of the first oblong opening 350 and the second oblong opening 354 as the jointed member 310 transitions from a first predetermined state to a second predetermined state without any significant amount of travel along the minor axis 370 of the first oblong opening 350 and the second oblong opening 354. So, for example, the distance between the parallel lines tangent to the end points of the two semicircles of the first and second obround openings 350 and 354 is approximately the diameter of the portion of the fastener 356, illustrated herein, that passes through the first and second obround openings 350 and 354.

Figure 4:
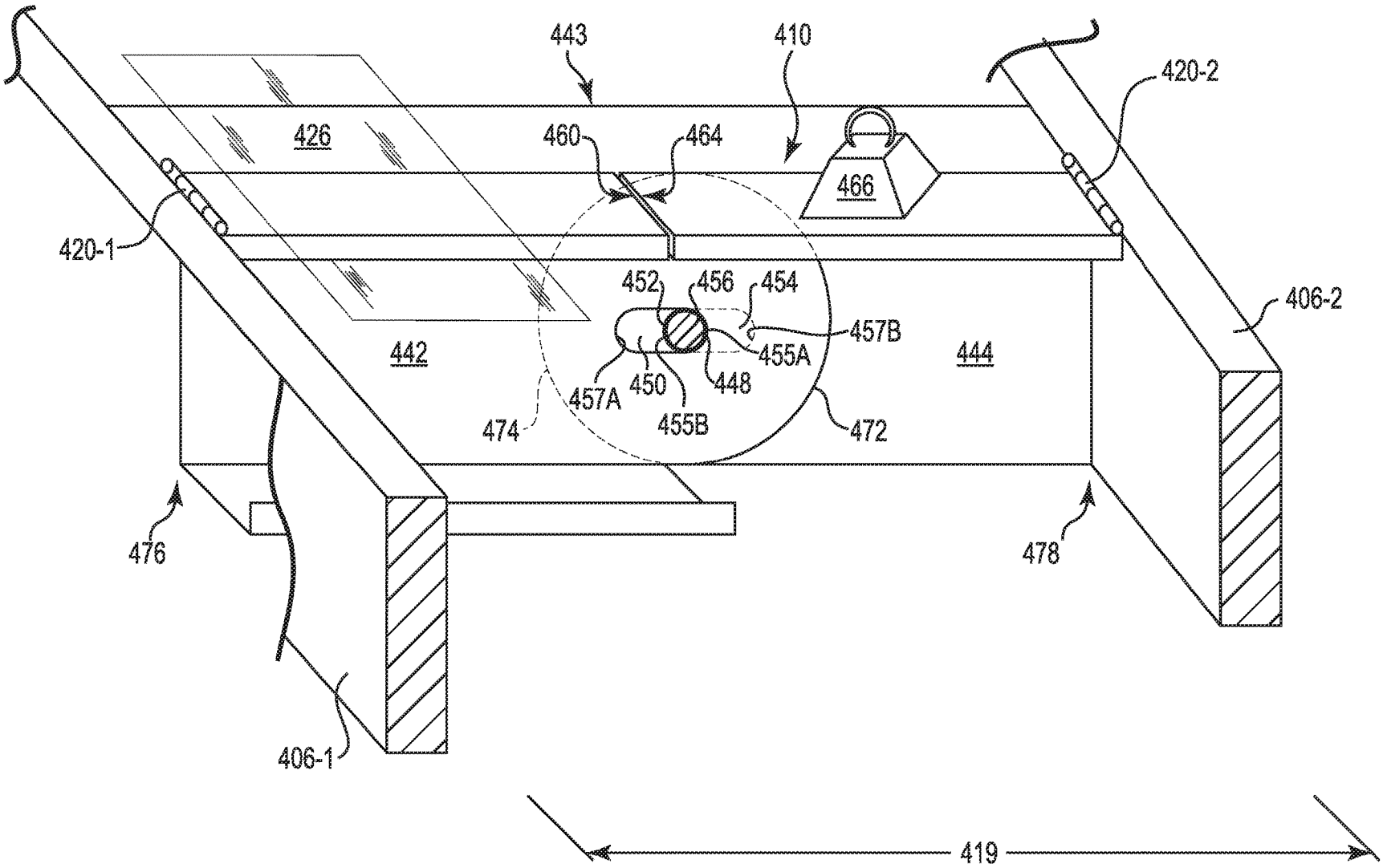
FIG. 4 illustrates a jointed member according to the present disclosure.
Figure 6:
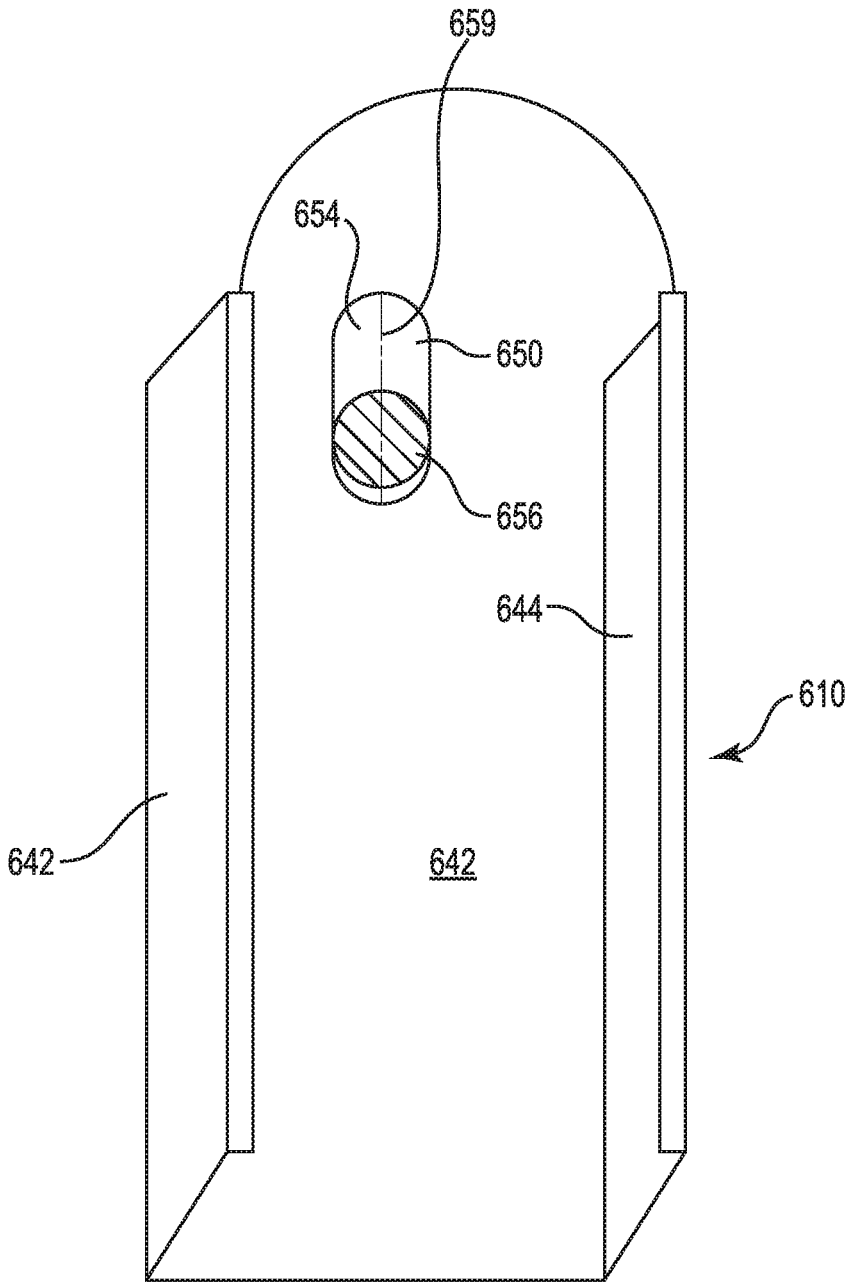
FIG. 6 illustrates a portion of the jointed member according to the present disclosure.

Referring now to FIG. 4, there is illustrated the first elongate section 442 and the second elongate section 444 of the jointed member 410 in the first predetermined state. In the first predetermined state the first oblong opening 450 and the second oblong opening 454 have a minimum overlap relative to the second predetermined state (an embodiment of the second predetermined state is shown in FIG. 6 and discussed more fully herein) of the jointed member 410 and the amount of overlap in the positions between the first and second predetermined states.

Specifically, the amount of overlap shown in FIG. 4 for the first predetermined state is approximately the cross sectional area of the portion of the fastener 456, shown from an end view, that passes through the openings 450 and 454. In one embodiment, the area of the overlap is equal to the cross sectional area of the portion of the fastener 456 that passes through the openings 450 and 454. For either embodiment discussed in this paragraph, the first oblong opening 450 and the second oblong opening 454 when in their first predetermined state also define a shape that corresponds to the cross-sectional shape of the portion of the fastener 456 that passes through the openings 450 and 454.

Referring again to FIG. 3, the surface 348 defining the first oblong opening 350 and the surface 352 defining the second oblong opening 354 each include the first end 355 and the second end 357 opposite the first end 355. The first end 355 and the second end 357 are each in the shape of an arc that helps the surfaces 348, 352 to form a circular shape when in the first predetermined state (seen in FIG. 4). For other embodiments, the first end 355 and/or the second end 357 may include one or more shapes including but not limited, a polygonal shape, a non-polygonal shape, and combinations thereof. In addition, the first oblong opening and the second oblong opening, as discussed herein, can be positioned at a number of different locations along a height 371 and/or a width 373 of the first end 358 of the first elongate section 342 and a first end 362 of the second elongate section 344.

So, as illustrated in FIG. 4, in the first predetermined state the first oblong opening 450 and the second oblong opening 454 provide a circular shape that corresponds to a circular cross-sectional shape of the portion of the fastener 456 that passes through the openings 450 and 454. In addition to have the same shape, the area defined by the first oblong opening 450 and the second oblong opening 454 in the first predetermined state is the cross sectional area of the portion of the fastener 456 that passes through the openings 450 and 454. As appreciated and as will be discussed herein, both the cross sectional area of the portion of the fastener 456 that passes through the openings 450 and 454 and the area defined by the first oblong opening 450 and the second oblong opening 454 in the first predetermined state are not so exacting that the first elongate section 442 and the second elongate section 444 bind so as to be unable to slide relative to each other and to rotate about the fastener 456.

In the first predetermined state a portion of the first surface 448 and a portion of the second surface 452 are in physical contact with the fastener 456 that passes through the openings 450 and 454. In other words, a portion of the surface 448 and a portion of the surface 452 sit or rest against a portion of the fastener 456 that passes through the openings 450 and 454 when in the first predetermined state.

As illustrated in FIG. 3, the first elongate section 342 includes a first end 358 having a first abutment member 360 and the second elongate section 344 includes a first end 362 having a second abutment member 364. In the first predetermined state the first abutment member 360 and the second abutment member 364 are in physical contact and a portion of the first surface 348 and a portion of the second surface 352 are in physical contact with the fastener 356. In other words, the first abutment member 360 and the second abutment member 364 abut when the jointed member 310 is in the first predetermined state. FIG. 4 provides an illustration of the first abutment member 460 and the second abutment member 464 in the first predetermined state, where the abutment members 460 and 464 abut.

Referring again to FIG. 3, when the jointed member 310 is in the first predetermined state, or the unfolded state, and a structural load 366 is applied to the joined member 310 the first abutment member 360 and the second abutment member 364 come under compression (e.g., each abutment member 360 and 364 applies a compressive force to the other). At the same time a portion of the first surface 348 of the first oblong opening 350 and the second surface 352 of the second oblong opening 354 apply a shearing stress to the portion of the fastener 356 that passes through the openings 350 and 354. For example, the shearing stress in the first predetermined state is applied to the fastener 356 by the first end 355 of both the first surface 348 (355-A) and the second surface 352 (355-B). As such, in the first predetermined state the fastener 356 is not free to move along the longitudinal axis 359 of the first oblong opening 350 and the second oblong opening 354. As a result, the structural load 366 is held in the first predetermined state on the jointed member 310, which has the compressive forces of the first abutment member 360 and the second abutment member 364 helping to offset the shear stress applied to the portion of the fastener 356 that passes through the openings 350 and 354.

As illustrated in FIG. 3 the first oblong opening 350 and the second oblong opening 354 have an obround shape each with the longitudinal axis 359 (a major axis) that is longer than the minor axis 370. The longitudinal axis 359 and the minor axis 370 can each have symmetry relative to each other. In addition, the length of the longitudinal axis 359 is greater than the length of the minor axis 370. For example, a ratio of a length of the longitudinal axis 359 to a length of the minor axis 370 are in a range of 10.0:1.0 to 1.1 to 1.0, 8.0:1.0 to 1.1:1.0, or 5.0:1.0 to 1.1:1.0. As used herein, "axis" does not necessarily imply symmetry, although for one or more embodiments the oblong opening may be symmetric about the major axis, the minor axis, or both axes. As used herein, "axis" refers to a straight line about which a geometric feature, e.g. an oblong opening, may be thought of as rotatable.

As illustrated in FIG. 3, the first end 358 of the first elongate section 342 further includes a surface 372 defining an arc, in this case a semi-circle, and the first end 362 of the second elongate section 344 further includes a surface 374 defining an arc, in this case a semi-circle. The surfaces 372 and 374 in the shape of an arc allow either the first end 358 of the first elongate section 342 or the first end 362 of the second elongate section 344 to move relative each other without interfering with either abutment member 360 or 364. For example, as the jointed member 310 transitions from the first predetermined state towards the second predetermined state the first end 358 of the first elongate section 342 can move relative the second abutment member 364 on the second elongate section 344. The shape of the surface 372 accommodates a travel path that does not come into contact with the second abutment member 364 on the second elongate section 344. Shapes other than an arc are possible and include, but are not limited to a polygonal shape, a non-polygonal shape, and combinations thereof.

As discussed herein, FIG. 4 illustrates an embodiment of the first elongate section 442 and the second elongate section 444 of the jointed member 410 in the first predetermined state, which may be referred to as an unfolded state. In the first predetermined state the first oblong opening 450 and the second oblong opening 454 have a minimum overlap relative to the second predetermined state (shown in FIG. 6 and discussed more fully herein) of the jointed member 410 and the amount of overlap in many of the positions between the first and second predetermined states. Specifically, the amount of overlap shown in FIG. 4 for the first predetermined state is approximately the cross sectional area of the portion of the fastener 456 (shown in cross section) that passes through the openings 450 and 454. In one embodiment, the area of the overlap is equal to the cross sectional area of the portion of the fastener 456 that passes through the openings 450 and 454. For either embodiment discussed in this paragraph, the first oblong opening 450 and the second oblong opening 454 when in their first predetermined state also define a shape that corresponds to the cross-sectional shape of the portion of the fastener 456 that passes through the openings 450 and 454.

FIG. 4 also illustrates the relative position of the first abutment member 460 and the second abutment member 464 in the first predetermined state. As illustrated, the first elongate section 442 of the jointed member 410 includes a first member end 476 that is opposite the first abutment member 460. Similarly, the second elongate section 444 of the jointed member 410 includes a second member end 478 that is opposite the second abutment member 464. In the first predetermined state, as shown in FIG. 4, a distance between the first member end 476 of the first elongate section 442 and the second member end 478 of the second elongate section 444 provides the defined maximum length 419 of the jointed member 410. As discussed with respect to FIG. 5A-5E, the distance between the first member end 476 of the first elongate section 442 and the second member end 478 of the second elongate section 444 does not exceed the defined maximum length 419 as the jointed member 410 transitions from the first predetermined state towards the second predetermined state.

Figures 2, 8A:
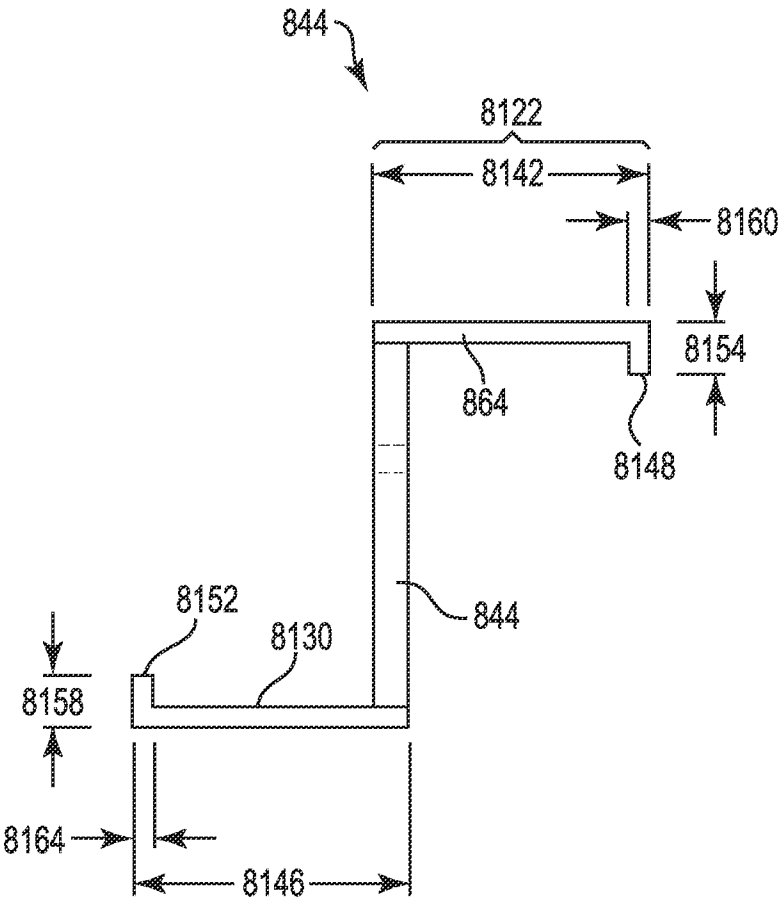
Figures 1, 8A:
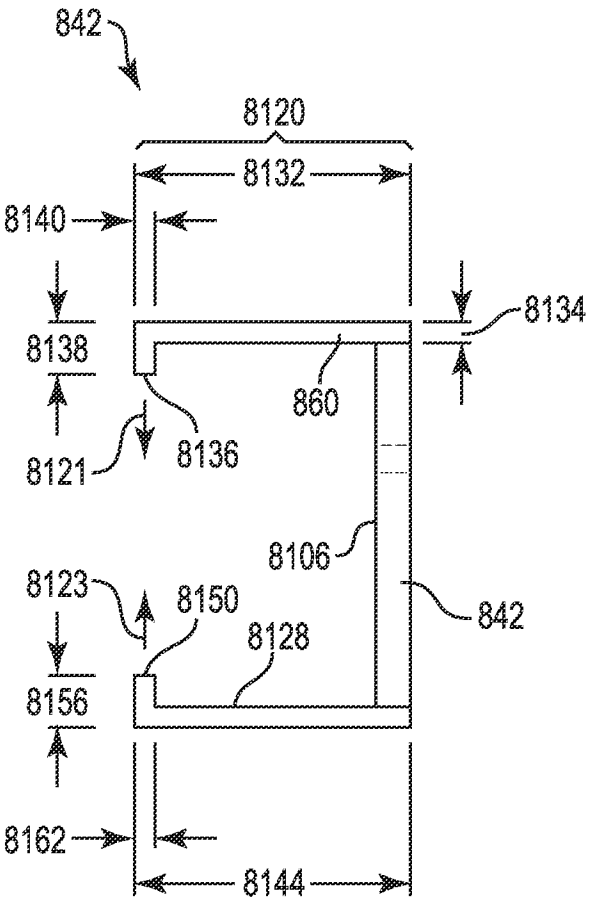

A hinge 420-1 connects the second first member end 476 of the first elongate section 442 to a side rail 406-1, such as the first bottom side rail discussed with respect to FIG. 1. Similarly, hinge 420-2 connects the second end 478 of the second elongate section 444 to a side rail 406-2, such as the second bottom side rail discussed with respect to FIG. 1. FIG. 4 also shows the defined maximum length 419 of the jointed member 410. As illustrated in FIGS. 5A-5D, the jointed member transitions from its first predetermined state (e.g., unfolded state) towards its second predetermined state (e.g., folded state) without having any portion of the jointed member extending beyond its defined maximum length 419 as defined in its first predetermined state.

FIG. 4 illustrates that when the jointed member 410 supports a structural load 466 the forces are distributed so as to cause the first abutment member 460 and the second abutment member 464 to be in compression and the surfaces 448 and 452 of the first and second oblong openings 450 and 454 to apply a shearing stress to the fastener 456. For example, the first end 455-A and the second end 455-B can apply a least a portion of the shearing stress to the fastener 456. It is also possible that ends 476 and 478 of the first elongate section 442 and the second elongate section 444, respectively, can apply a compressive force against their respective side rails 406-1 and 406-2 as a result of the jointed member 410 supporting the structural load 466. In one embodiment, the ability of the ends 476 and 478 of the first elongate section 442 and the second elongate section 444 to apply a compressive force against their respective side rails 406-1 and 406-2 can eliminate the need for the first abutment member 460 and the second abutment member 464. This is because in supporting the structural load 466 the shearing stress applied at the surfaces 448 and 452 are offset by the compressive forces applied between the ends 476 and 478 and their respective side rails 406-1 and 406-2.

FIG. 4 further illustrates that as the structural load 466 is held in the first predetermined state on the jointed member 410 the first abutment member 460 and the second abutment member 464, under a compressive force, and the surfaces 448 and 452 applying the shearing stress to the fastener 456, with help from the hinges 420-1 and 420-2, prevent the jointed member 410 from bending or deflecting to any significant degree away from the plane 426. In one embodiment, structure 443, illustrated as a cable, can be used to help prevent the jointed member 410 from bending or deflecting to any significant degree away from the plane 426. Because a function of structure 443 is to prevent the jointed member 410 from bending or deflecting to any significant degree away from the plane 426, structure 443 would also prevent the jointed member 410 from folding, as discussed herein, but for the ability of the jointed member 410 to overcome the hypotenuse issue discussed herein.

For the various embodiments, the static interaction of the first abutment member 460 and the second abutment member 464, under a compressive force, and the surfaces 448 and 452 applying the shearing stress to the fastener 456, with help from the hinges 420-1 and 420-2, allow the joined member 410 of the present disclosure to carry the structural load 446 (e.g., as prescribed in ISO standard 1496).

Referring now to FIGS. 5A-5D there is shown the jointed member 510 transitioning from the first predetermined state towards the second predetermined state without any portion of the jointed member 510 extending beyond its defined maximum length 519. During this transition the first oblong opening, the second oblong opening, and the fastener can move relative each other. This relative movement helps to provide that the reversibly foldable freight container transitions from the first predetermined state towards the second predetermined state (e.g., a folded state) without expanding beyond either the defined maximum length 519 or the maximum defined width provided in the first predetermined state, while neither bowing or damaging the jointed member, a pivotal connection (e.g., a hinge) or a structure 543 of the container. In other words, this relative movement has an effect of overcoming the hypotenuse issue discussed herein.

For the various embodiments, the jointed member 510 can fold in a way that the components of the reversibly foldable freight container do not extend beyond their predefined width (e.g., the ISO standard width of eight (8) feet measured at corner fittings as provided in ISO 668 Fifth Edition 1995-12-15). For one or more embodiments, the joined member 510 has the attributes of a compound hinge. Specifically, the joined member 510 has at least two distinct and separate axes of rotation that are used during the folding and/or the un-folding of the jointed member 510.

FIGS. 5A-5D illustrate the first elongate section 542 connected to a first bottom side rail 506-1 by a hinge 520-1 and the second elongate section 544 connected to a second bottom side rail 506-2 by a hinge 520-2. FIGS. 5A-5D also illustrate the first elongate section 542 and the second elongate section 544 joined by the fastener 556 that passes through the first and second oblong opening 550 and 554, respectively. The fastener 556 is shown in cross-section in FIG. 5A-5E to better illustrate its relationship to the first and second oblong opening 550 and 554 as the jointed member 510 moves from the first predetermined, or unfolded, position towards the second predetermined, or the folded position.

Figure 5A:
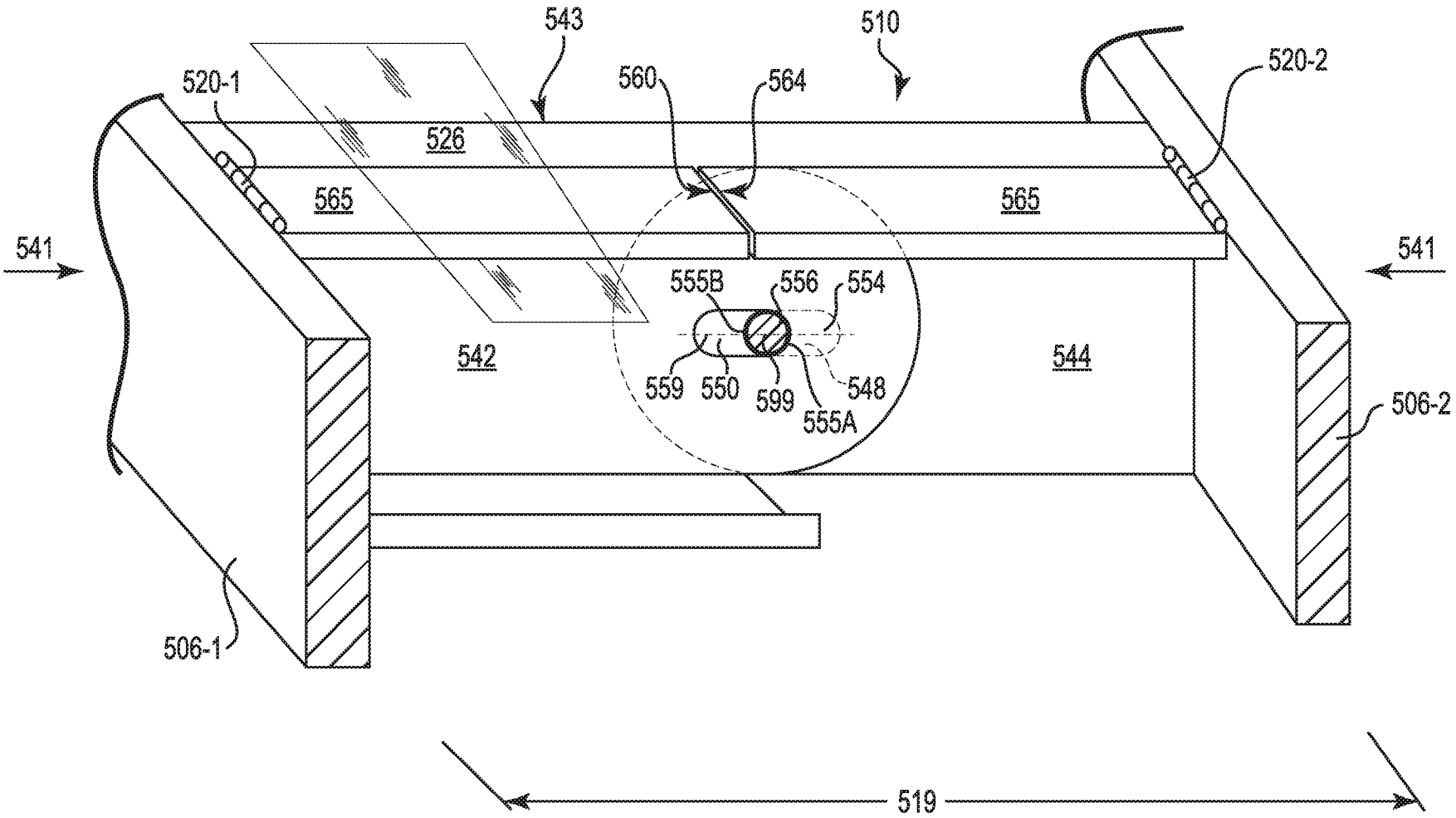
FIGS. 5A-5F illustrate a jointed member according to the present disclosure.

In FIG. 5A the jointed member 510 is shown in its first predetermined state having its defined maximum length 519.

In this first predetermined state: the first and second abutment members 560 and 564 are in contact; the overlap of the first and second oblong openings 550 and 554 is at a minimum relative the second predetermined state (seen in FIG. 6); and the surfaces 548 and 552 of the first elongate section 542 and the second elongate section 544 define the cross-sectional shape of the portion of the fastener 556 passing through the first and second oblong openings 550 and 554. FIG. 5A also shows an upper surface 565 of the first and second elongate sections 542 and 544. Plane 526 contacts the upper surface 565. When the jointed member 510 carries a structural load 566 the upper surface 565 of the abutment members 560 and 564 continue to contact the plane 526.

Figure 5B:
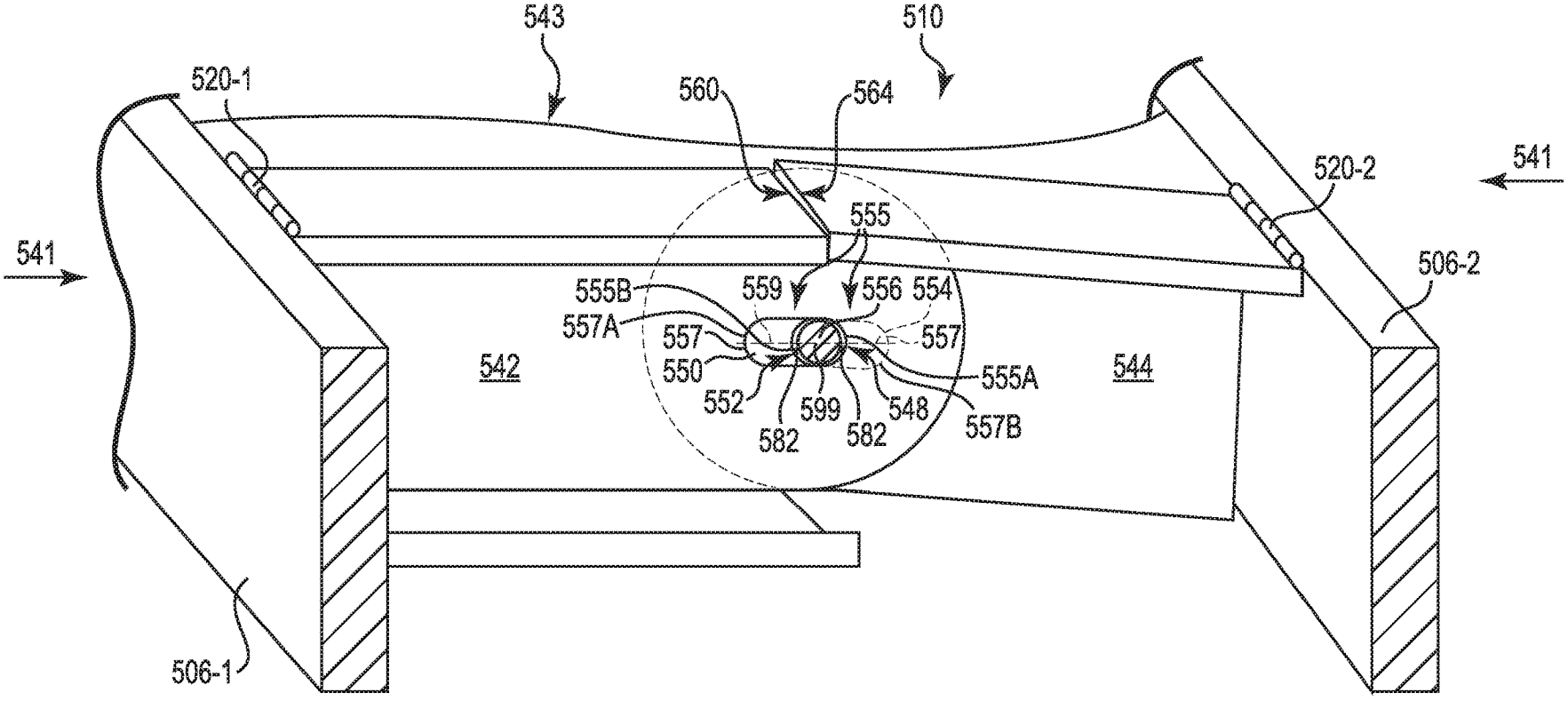

As the jointed member 510 begins to fold different portions of the jointed member 510 move so as to rotate around predefined points of rotation (e.g., a first axis of rotation), to slide relative one or more of the other parts of the jointed member 510 and/or to shift relative positions at different stages of the folding process. Referring now to FIG. 5B, the jointed member 510 is shown beginning to fold from its first predetermined state, as seen in FIG. 5A, towards the second predetermined state, as seen in FIG. 6. As illustrated in FIG. 5B, the first abutment member 560 and the second abutment member 564 define a first point of rotation around a first axis of rotation for the first elongate section 542 and the second elongate section 544. In other words, the first point of rotation around which the first elongate section 542 and the second elongate section 544 rotate is defined at the point of contact between the first abutment member 560 and the second abutment member 564. Rotation about this first point of rotation may be caused, at least in part, to a force applied to the joined member in the direction 541. As the first elongate section 542 and the second elongate section 544 rotate around the first point of rotation defined by the first abutment member 560 and the second abutment member 564 the surfaces 548 and 552 defining the first oblong opening 550 and the second oblong opening 554 move relative each other. The fastener 556 can also move (e.g., laterally) within the first oblong opening 550 and/or the second oblong opening 554 as the jointed member 510 transitions from the first predetermined state towards the second predetermined state. In transitioning towards the second predetermined state the fastener 556 is mobile within the first oblong opening 550 and/or the second oblong opening 554. As discussed herein, the axial center 599 of the fastener 556 moves along (e.g., essentially parallel with) the longitudinal axis 559 of the first oblong opening 550 and the second oblong opening 554 as the jointed member 510 transitions from a first predetermined state to a second predetermined state. The cross-sectional shape of the fastener 556 is of a size and a shape that allows the fastener 556 to travel along the longitudinal axis 559 of the first oblong opening 550 and the second oblong opening 554 as the jointed member 510 transitions from the first predetermined state to the second predetermined state without any significant amount of travel along the minor axis 570 of the first oblong opening 550 and the second oblong opening 554. So, for example, the distance between the parallel lines tangent to the end points of the two semicircles of the first and second obround openings 550 and 554 is approximately the diameter of the portion of the fastener 556, illustrated herein, that passes through the first and second obround openings 550 and 554.

As illustrated in FIG. 5B, the fastener 556 has moved laterally, (e.g. in a direction coincident with the longitudinal axis 559) within the first oblong opening 550. Likewise, the fastener 556 may move laterally within the second oblong opening 554, (e.g. in a direction coincident with the longitudinal axis 559). FIG. 5B shows how a gap 582 develops between the fastener 556 and the first end 555 of the surfaces defining the first oblong opening 550 (555-A) and the second oblong opening 554 (555-B). The jointed member 510 can rotate around a point of contact (e.g., a predetermined point of contact) between the first abutment member 560 and the second abutment member 564 until the second ends 557 of the first oblong opening 550 (557-A) and the second oblong opening 554 (557-B) contact the fastener 556, for example. As such, the axis of rotation changes as the jointed member 510 transitions from the first predetermined state to the second predetermined state. For example, the axis of rotation changes as the jointed member 510 transitions from its first predetermined state until the second ends 557 of the first oblong opening 550 (557-A) and the second oblong opening 554 (557-B) contact the fastener 556.

Figure 5C:
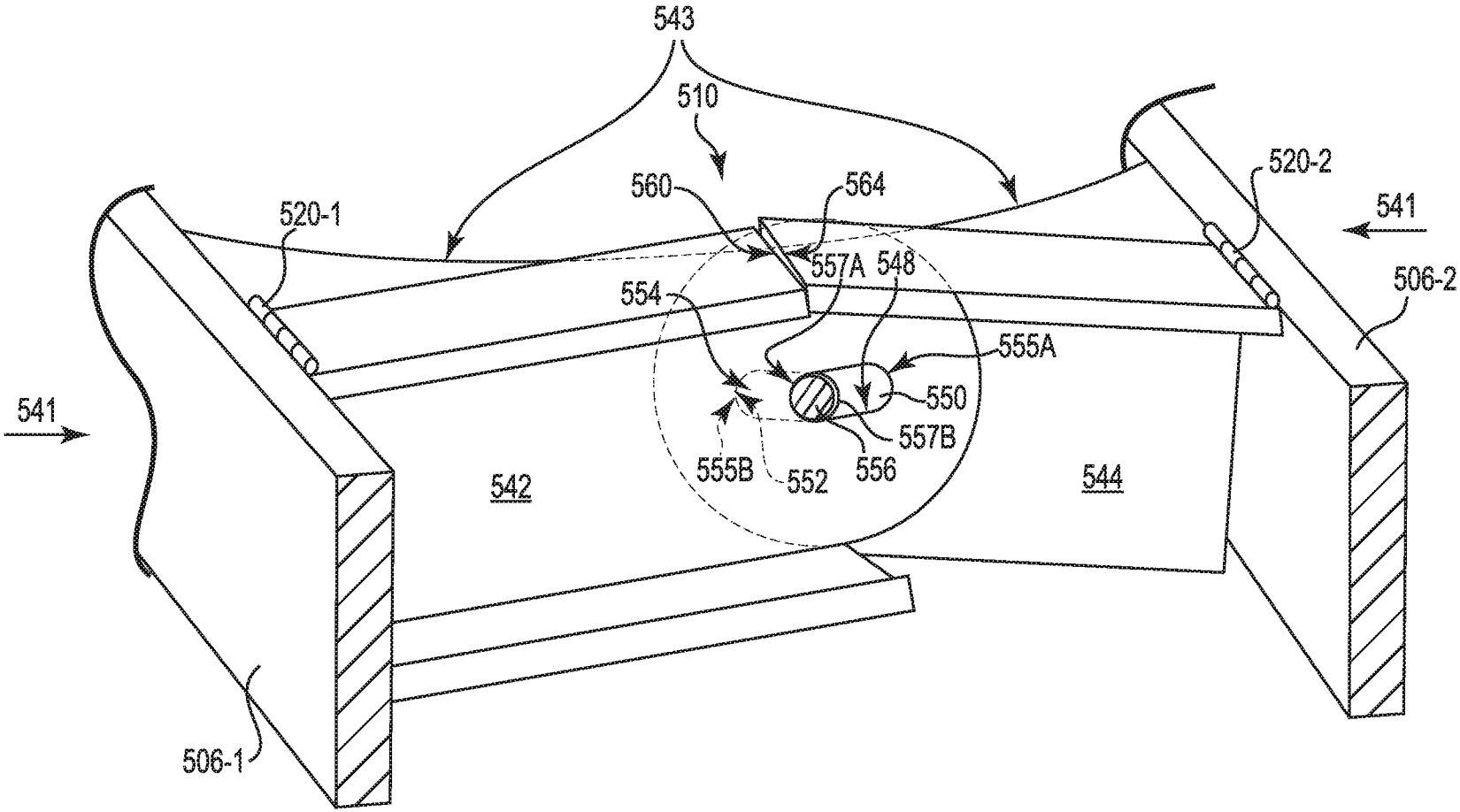

This embodiment, where the second ends 557 of the first oblong opening 550 (557-A) and the second oblong opening 554 (557-B) contact the fastener 556, is illustrated in FIG. 5C. FIG. 5C also illustrates that the point of rotation now shifts from the first point of rotation, defined by the first abutment member 560 and the second abutment member 564, to a second point of rotation on a second axis of rotation that is formed by the second end 557 of both the first surface 548 of the first oblong opening 550 (557-A) and the second surface 552 of the second oblong opening 554 (557-B) when positioned against the fastener 556.

This second point of rotation around a second axis of rotation for the first abutment member 560 and the second abutment member 564 is different than the first point of rotation discussed herein. As before, the rotation about this second point of rotation may be caused, at least in part, to a force applied to the joined member in the direction 541.

As illustrated in FIGS. 5A-5C, the first elongate section 542 and the second elongate section 544 rotate around (e.g., turn on) the first point of rotation prior to rotating around (e.g., turning on) the second point of rotation as the jointed member 510 transitions from the first predetermined state towards the second predetermined state. Also, as illustrated in FIG. 5C the first end 555 of each of the first surface 548 (555-A) and the second surface 552 (555-B) does not contact the fastener 556 when the second end 557 of both the first surface 548 (557-A) and the second surface 552 (557-B) are seated against the fastener 556.

In shifting from the first point of rotation to the second point of rotation the length of the hypotenuse of the jointed member 510 changes from an initial value when the jointed member 510 is in the first predetermined state (as discussed herein) to a shorter value, relative the initial value, such as when the point of rotation shifts to the point of contact between the second end 557 of the first oblong opening 550 (557-A) and the second oblong opening 554 (557-B) and the fastener 556.

Figure 5D:
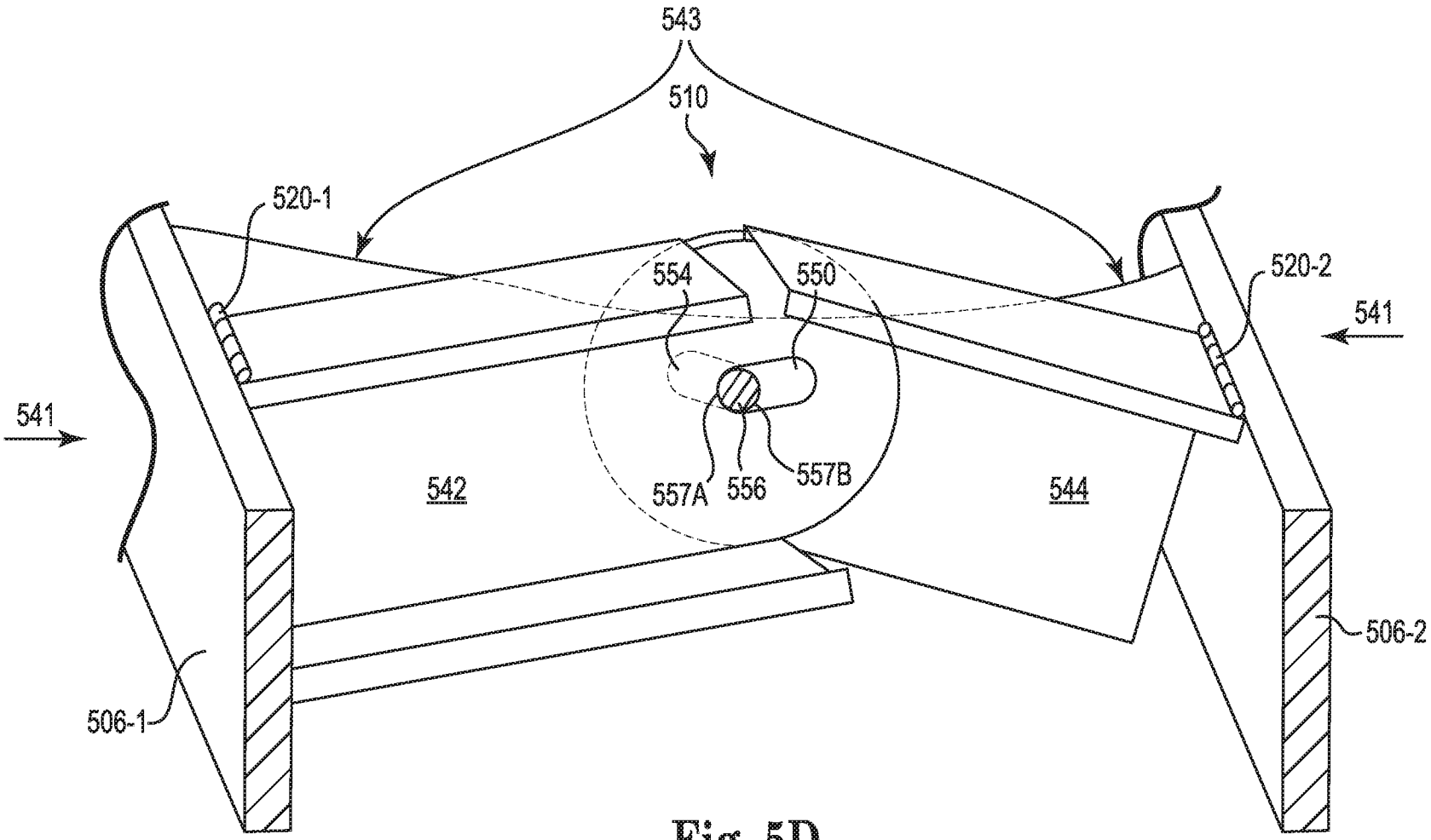
Figure 5E:
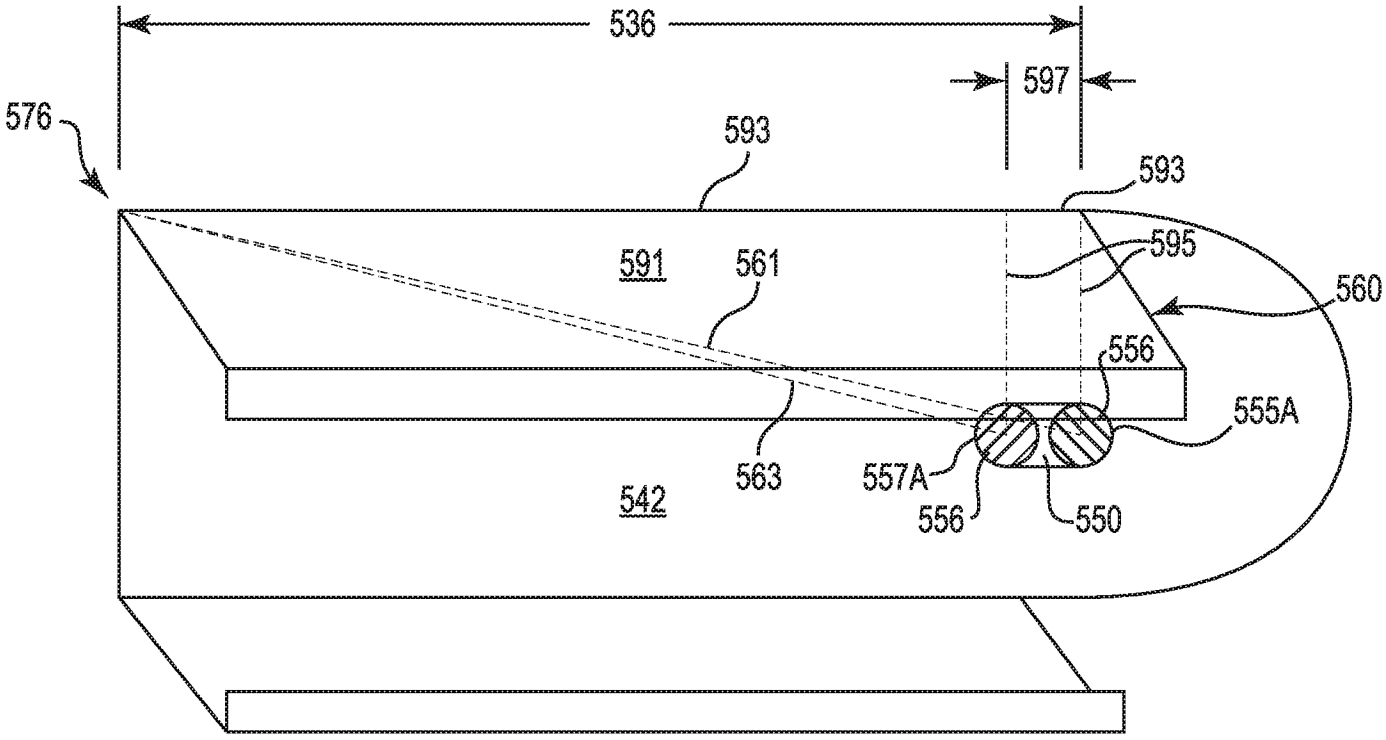
Figure 5F:
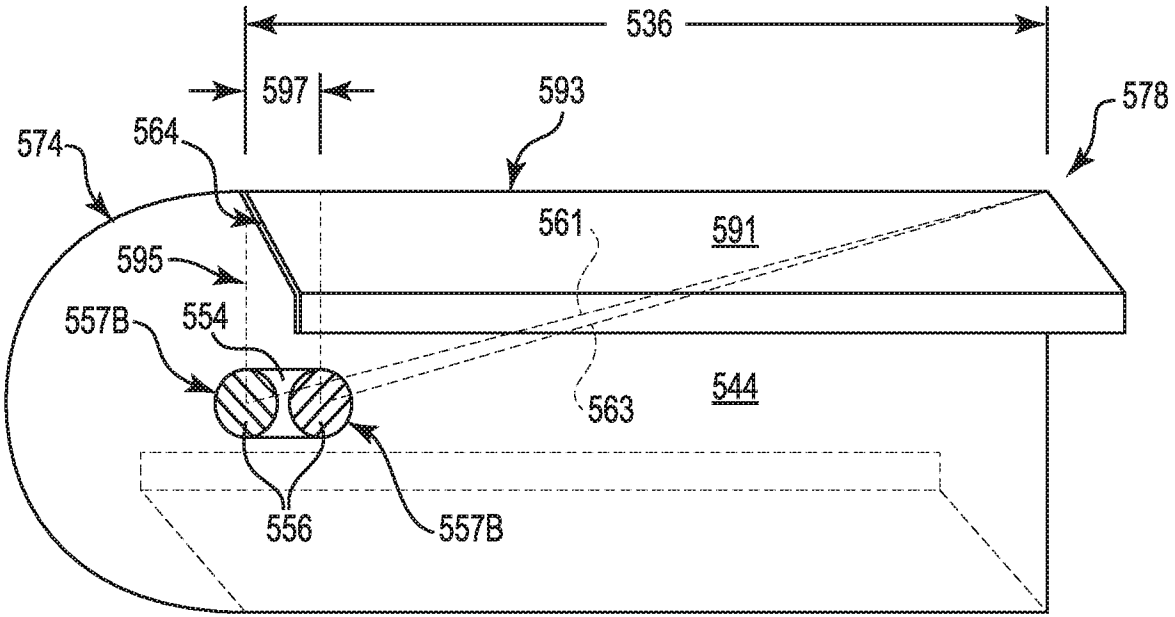

FIGS. 5E and 5F can be used to illustrate this change in the length of the hypotenuse of the jointed member 510. The broken lines 561 and 563 in FIGS. 5E and 5F show the hypotenuse of jointed member 510 when the jointed member is at either the first point of rotation or the second point of rotation. In FIG. 5E, there is shown the first elongate section 542, where in the first predetermined state the fastener 556, the first abutment member 560 and the first member end 576, all in a common plane, define a right triangle 591 of the first elongate section 542, where a hypotenuse of the right triangle 591 is between the fastener 556 and the first member end 576 and a first leg 536 of the right triangle 591 is defined by the first member end 576 and the perpendicular intersection of a first line 593 extending from the first member end 576 and a second line 595 extending from the geometric center of the fastener 556, where the first and second lines 593 and 595 are in the common plane.

As illustrated in FIG. 5E, when in the first predetermined state the broken line 561 shows the hypotenuse of jointed member 510. When the point of rotation shifts to the second point of rotation the broken line 563 shows the now shortened hypotenuse, relative the hypotenuse in the first predetermined state. In addition to being shorter than broken line 561, the hypotenuse shown by broken line 563 can be equal to or shorter than the first leg 536 of the right triangle 591 of the first elongate section 542 when the jointed member is in the first predetermined state. In this way, the jointed member 510 having the now shortened hypotenuse can pass through, for example, the defined maximum length 519, as discussed herein.

Similarly, in FIG. 5F there is shown the second elongate section 544, where in the first predetermined state the fastener 556, the second abutment member 564 and the second member end 578, all in a common plane, define a right triangle 591 of the second elongate section 544, where a hypotenuse of the right triangle 591 is between the fastener 556 and the second member end 578 and a first leg 536 of the right triangle 591 is defined by the second member end 578 and the perpendicular intersection of a first line 593 extending from the second member end 578 and a second line 595 extending from the geometric center of the fastener 556, where the first and second lines 593 and 595 are in the common plane.

As illustrated in FIGS. 5E and 5F, in the first predetermined state the hypotenuse has a length that is greater than a length of the first leg 536. However, as the first abutment member 560 and the second abutment member 564 rotate about the second point of rotation the length of the hypotenuse changes as the geometric center of the fastener 556 moves along a length 597 between the first and second ends of the oblong openings 550 and 554. This allows the hypotenuse (as shown by broken line 563) to be no greater than the length of the first leg 536 of the right triangle 591 of the first elongate section 542. As such, as the first abutment member 560 and the second abutment member 564 rotate about the second point of rotation the length between the fastener 556 and the first member end 576, both in the common plane, is no greater than the length of the first leg 536 of the right triangle 591 of the first elongate section 542. Similarly, as the first abutment member 560 and the second abutment member 564 rotate about the second point of rotation the length between the fastener 556 and the second member end 578, both in the common plane, is no greater than the length of the first leg 536 of the right triangle 591 of the second elongate section 544.

As discussed herein, the defined maximum length 519 in the first predetermined state can be twice the length of the first leg 536 of the right triangle 591 of the first elongate section 542 or the second elongate section 544. As the jointed member 510 begins to fold the first point of rotation is near or at a point where the first abutment member 560 and the second abutment member 564 are in contact. As the jointed member 510 continues to fold the point of rotation shifts to the second point of rotation, when the second end 557 of the first oblong opening 550 and the second oblong opening 554 contact the fastener 556, for example. At this point, the hypotenuse of each of the elongate members of the jointed member has been effectively changed to a length equal to or less than that of the first leg 536. The first elongate section 542 and the second elongate section 544 of the jointed member 510 can then continue to fold towards the second predetermined state without extending beyond the defined maximum length 519 defined in the first predetermined state. For un-folding of the jointed member 510 a force opposite the force 541, for example, may be applied to the folded jointed member to cause the jointed member 510 to return to its first predetermined state as seen in FIG. 5A. In returning to its first predetermined state the defined maximum length 519 is not exceeded.

Referring now to FIG. 6, there is shown an embodiment of the jointed member 610 in the second predetermined state in which the first oblong opening and the second oblong opening can have their maximum overlap relative the first predetermined state. FIG. 6 illustrates the second predetermined state having a maximum overlap of the first oblong opening 650 and the second oblong opening 654 relative the minimum overlap, as discussed herein. In the embodiment illustrated in FIG. 6 the fastener 656 is free to move along the longitudinal axes 659 of the first oblong opening and the second oblong when the first oblong opening and the second oblong opening are in the second predetermined state.

In the second predetermined state, FIG. 6 shows the first oblong opening 650 completely overlapping the second oblong opening 654. While FIG. 6 illustrates a complete overlap of the first oblong opening 650 and the second oblong opening 654 it is intended that the overlap may be substantially complete, e.g. due to machine tolerances and so forth. This relationship between the first oblong opening 650 and second oblong opening 654 may be considered the maximum overlap of the first oblong opening and the second oblong opening relative the minimum overlap, as discussed herein. In other words a value of an area of the maximum overlap cannot be further increased by repositioning either the first elongate section or the second elongate section.

In the perspective view provided by FIG. 6 the second elongate section 644 is hidden from view by the first elongate section 642. In this second predetermined state the first elongate section 642 including the first oblong opening 650 is aligned with the second elongate section 644 including the second oblong opening 654. In other words, the first elongate section 642 is opposed the second elongate section 644. Herein the first elongate section 642 is opposed the second elongate section 644 when the longitudinal axis of the first elongate section 642 and the longitudinal axis of the second elongate section 644 are substantially parallel and the jointed member 610 is not in the first predetermined state. When the first elongate section 642 opposes the second elongate section 644, the longitudinal axes of the first elongate section 642 and the second elongate section 644 are in a position that is substantially perpendicular relative to the longitudinal axes of the first elongate section 642 and the second elongate second 644 in the first predetermined state. When the first elongate section 642 opposes the second elongate section 644, the jointed member 610 is considered to be in a folded state.

It is appreciated, however, that the jointed member as discussed herein can be placed into one or more intermediate positions between the first predetermined position (as seen in FIGS. 4 and 5A) and the second predetermined position (as seen in FIG. 6). For example, FIGS. 5B-5D illustrate intermediate positions between the first predetermined position and the second predetermined position.

Figure 7:
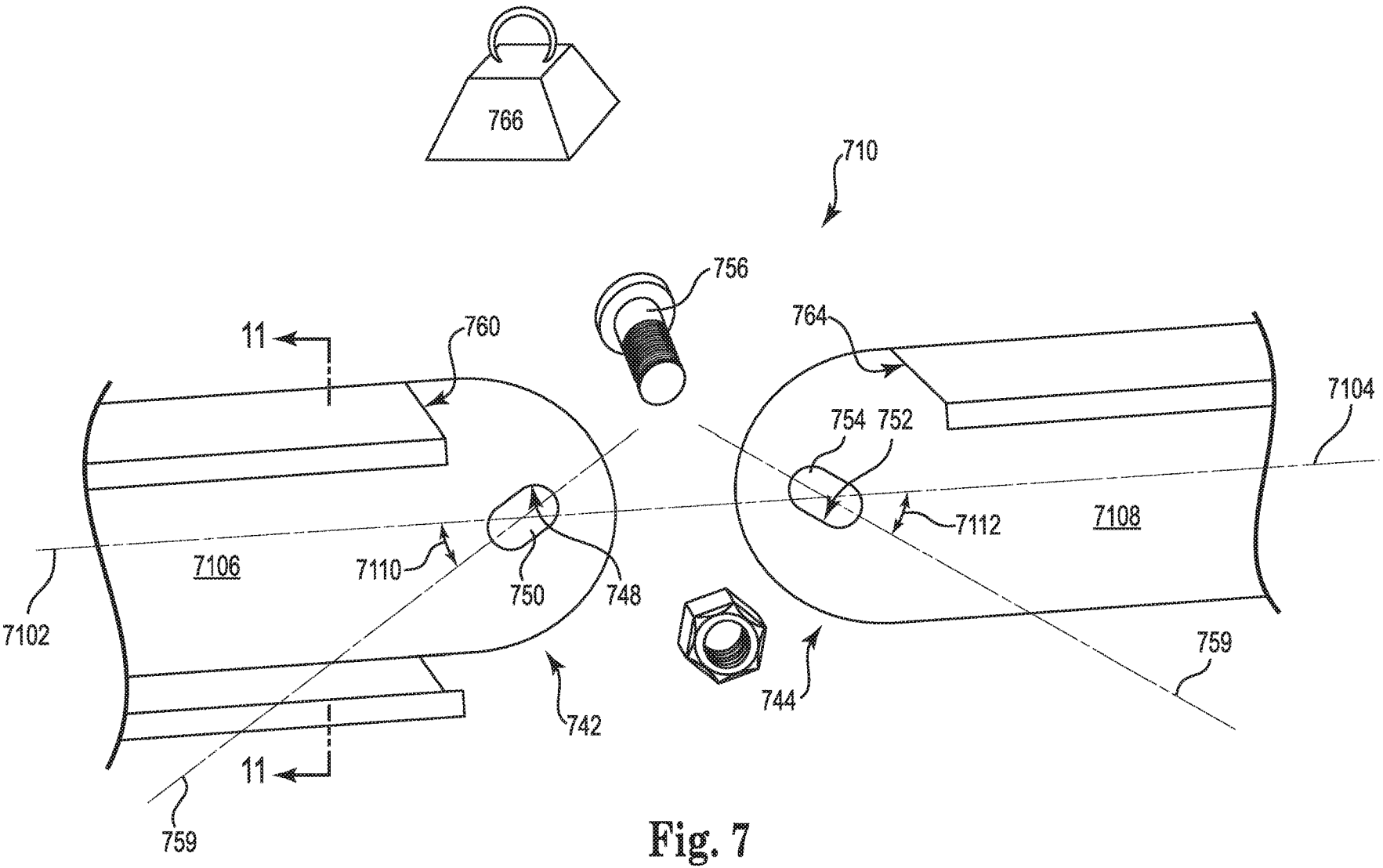
FIG. 7 illustrates an exploded view of a jointed member according to the present disclosure.

FIG. 7 illustrates an exploded view of an embodiment of the first elongate section 742 and the second elongate section 744 and the fastener 756 of the jointed member 710 of the present disclosure. The first elongate section 742 includes a longitudinal axis 7102 and the second elongate section 744 includes a longitudinal axis 7104. For one or more embodiments, in the first predetermined state the longitudinal axis 7102 of the first elongate section 742 is substantially coplanar with the longitudinal axis 7104 of the second elongate section 744. For example, the longitudinal axis 7102 may bisect the first elongate section 742 and the longitudinal axis 7104 may bisect the second elongate section 744. In the first predetermined state the longitudinal axis 7102 and the longitudinal axis 7104 are substantially parallel, e.g. both of the axes lie in a plane that is perpendicular to a first major surface 7106 of the first elongate section 742 and a first major surface 7108 of the second elongate section 744.

For one or more embodiments, a first angle 7110 formed from the longitudinal axis 759 of the first oblong opening 750 and the longitudinal axis 7102 of the first elongate section 742 has a value from 0 degrees to 45 degrees. For example the first angle 7110 may have a value of 0 degrees, 15 degrees, 20 degrees, 25 degrees 30 degrees, 35 degrees or 45 degrees. Similarly, a second angle 7112 formed from the longitudinal axis 759 of the second oblong opening 754 and the longitudinal axis 7104 of the second elongate section 744 has a value from 0 degrees to 45 degrees. For example the second angle 7112 may have a value of 0 degrees, 15 degrees, 20 degrees, 25 degrees 30 degrees, 35 degrees or 45 degrees.

In the present embodiment, the first surface 748 defines the first oblong opening 750 through the first elongate section 742, and the second surface 752 defines the second oblong opening 754 through the second elongate section 744. In the first predetermined state, or the unfolded state, a structural load 766 applied to the joined member 710 causes the first abutment member 760 and the second abutment member 764 to come under compression (e.g., each abutment member 760 and 764 applies a compressive force to the other). As the same time a portion of the surface 748 of the first oblong opening 750 and a portion of the surface 752 of the second oblong opening 754 apply a shearing stress to the portion of the fastener 756 that passes through the openings 750 and 754. As a result, the structural load 766 is held in the first predetermined state on the jointed member 710, which has the compressive forces of the first abutment member 760 and the second abutment member 764 help to offset the shear stress applied to the portion of the fastener 756 that passes through the openings 750 and 754. As illustrated in FIG. 7 the first oblong opening 750 and the second oblong opening 754 have an obround shape.

FIGS. 8A-1 and 8A-2 illustrate the first elongate section 842 (FIG. 8-1) taken along cut line A-A, as illustrated in FIG. 3, and the second elongate section 844 (FIG. 8-2) taken along cut line B-B, as illustrated in FIG. 3. The first elongate section 842 has a width 8120 and the second elongate section 844 has a width 8122. For differing applications, the width 8120 and the width 8122 may have various values. The first elongate section 842 includes a first abutment member 860 and the second elongate section 844 includes a second abutment member 864. The first elongate section 842 includes a third abutment member 8128. The second elongate section 844 includes an adjunct member 8130. The first abutment member 860, the second abutment member 864, the third abutment member 8128 and/or the adjunct member 8130 may be referred to as a flange or a return.

For differing applications, the first abutment member 860 may have a width 8132 of various values. For example, when the jointed member is employed for the reversibly foldable freight container, the width 8132 may have a value in a range from 1.0 centimeter to 25.0 centimeters. For differing applications, the first abutment member 860 may have a height 8134 of various values. For example, when the jointed member is employed for the reversibly foldable freight container the height 8134 may have a value in a range from 0.1 centimeters to 5.0 centimeters. As appreciated values for the width 8132 and the height 8134 can be dependent upon the application in which the jointed member is to be used.

The first abutment member 860 may include a reinforcement section 8136. The reinforcement section 8136 may have a width 8138 of differing values. For example, the width 8138 may have a value in a range from 0.5 centimeters to 10.0 centimeters. The reinforcement section 8136 may have a height 8140 of differing values. For example, the height 8140 may have a value in a range from 0.1 centimeters to 5.0 centimeters. As appreciated values for the width 8138 and the height 8140 can be dependent upon the application in which the jointed member is to be used.

Similar to the first abutment member, the second abutment member 864, the third abutment member 8128, and the adjunct member 8130 may have a width 8142, 8144, and 8146 respectively. Each of the widths 8142, 8144, 8146 may have a value in a range from 1.0 centimeter to 25.0 centimeters. As appreciated values for the widths 8142, 8144, 8146 can be dependent upon the application in which the jointed member is to be used.

Additionally similar to the first abutment member, the second abutment member 864, the third abutment member 8128, and the adjunct member 8130 may each have a reinforcement section 8148, 8150, and 8152 respectively. Each of the reinforcement sections 8148, 8150, 8152 may have a width 8154, 8156, and 8158 respectively having a value in a range from 0.5 centimeters to 10.0 centimeters. Each of the reinforcement sections 8148, 8150, 8152 may have a height 8160, 8162, and 8164 respectively having a value in a range from 0.1 centimeters to 5.0 centimeters. The reinforcement sections may help provide strength, e.g. resistance to movement in a non-movable direction.

As illustrated in FIG. 8A-1, the reinforcement section 8136 and the reinforcement section 8150 extend towards one another. For example, a first line that is perpendicular to and passes through the first major face 8106 may intersect the reinforcement section 8136 while a second line that is perpendicular to and passes through the first major face 8106 may intersect the reinforcement section 8150. When the reinforcement section 8136 and the reinforcement section 8150 extend towards one another these reinforcement sections extend in opposite directions. As illustrated in FIG. 8A-1, the reinforcement section 8136 extends in a first direction 8121 and the reinforcement section 8150 extends in a second direction 8123 that is opposite of the first direction 8121.

Figure 8B:
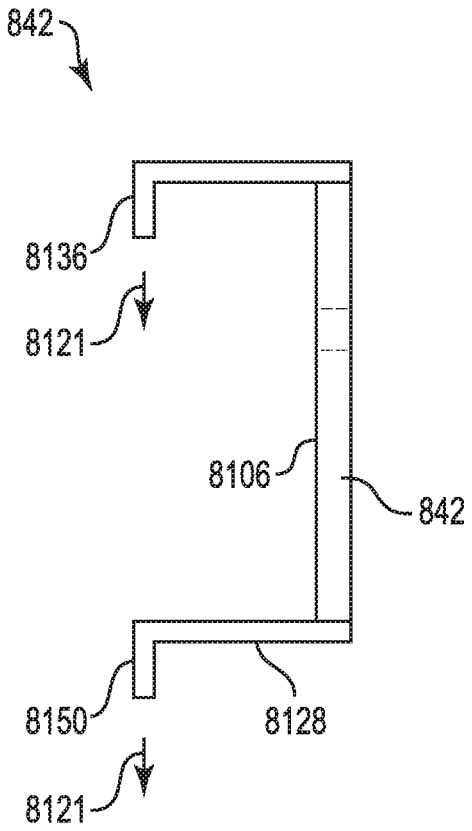

FIG. 8B illustrates an alternative embodiment of the first elongate section 842. As illustrated, the reinforcement section 8136 extends towards the reinforcement section 8150 while the reinforcement section 8150 extends away from the reinforcement section 8136. For example, a first line that is perpendicular to and passes through the first major face 8106 may intersect the reinforcement section 8136 while a second line that is perpendicular to and passes through the first major face 8106 cannot intersect the reinforcement section 8150. As illustrated in FIG. 8B, the reinforcement section 8136 extends in the first direction 8121 and the reinforcement section 8150 extends in the first direction 8121.

Figure 8C:
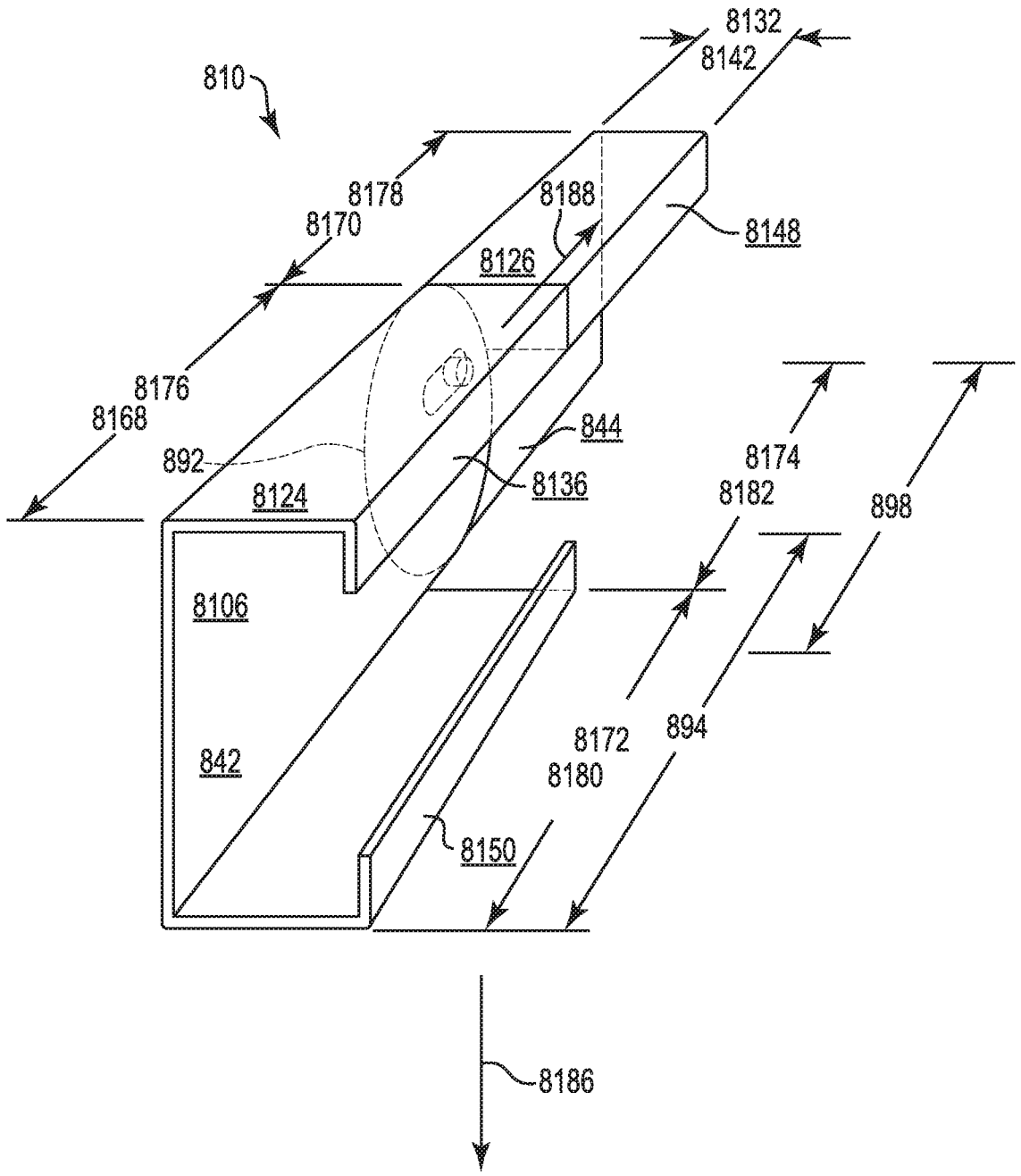

FIG. 8C illustrates the jointed member 810 in the first predetermined state. The first abutment member 860, the second abutment member 864, the third abutment member

8128, and the adjunct member, which are hidden from view in FIG. 8C, may each have a length 8168, 8170, 8172, respectively. For differing applications, the first abutment member, the second abutment member, the third abutment member, and the adjunct member may have various values of length. For one or more embodiments, the first abutment member, the second abutment member, the third abutment member, and the adjunct member each respectively have a length in a range from a value greater than zero (0) meters (e.g., 0.25 meters) to 1.5 meters. As appreciated values for the length of the first abutment member, the second abutment member, the third abutment member, and the adjunct member can be dependent upon the application in which the jointed member is to be used.

The reinforcement sections 8136, 8148, 8150 and 8152, which are hidden from view in FIG. 8C, may each have a length 8176, 8178, 8180, and 8182 respectively. For differing applications, reinforcement sections may have various values. For one or more embodiments, the lengths 8176, 8178, 8180, 8182 each respectively have a value greater than zero (0) meters (e.g., 0.25 meters) to 1.5 meters. As appreciated values for the length of the first abutment member, the second abutment member, the third abutment member, and the adjunct member can be dependent upon the application in which the jointed member is to be used.

One or more of the lengths 8168, 8172 and one or more of the lengths 8176, 8180, may have a value that is less than a length 894 of the first elongate section 842. For one or more embodiments, one or more of the lengths 8170, 8174 and one or more of the lengths 8178, 8182, may have a value that is less than a length 898 of the second elongate section 844. As illustrated in FIG. 8C, when the jointed member 810 is in the first predetermined state the first abutment member 860 and the second abutment member 864 extend in a first direction, e.g. direction 8188. Additionally, the third abutment member 8128 may extend in the first direction 8188.

As illustrated in FIG. 8C, when the jointed member 810 is in the first predetermined state the first abutment member 860 abuts the second abutment member 864. The contact between the first abutment member 860 and the second abutment member 864 helps to prevent the jointed member 810 from moving from the first predetermined state toward a direction 8186, e.g. the non-moveable direction.

Figure 9A:
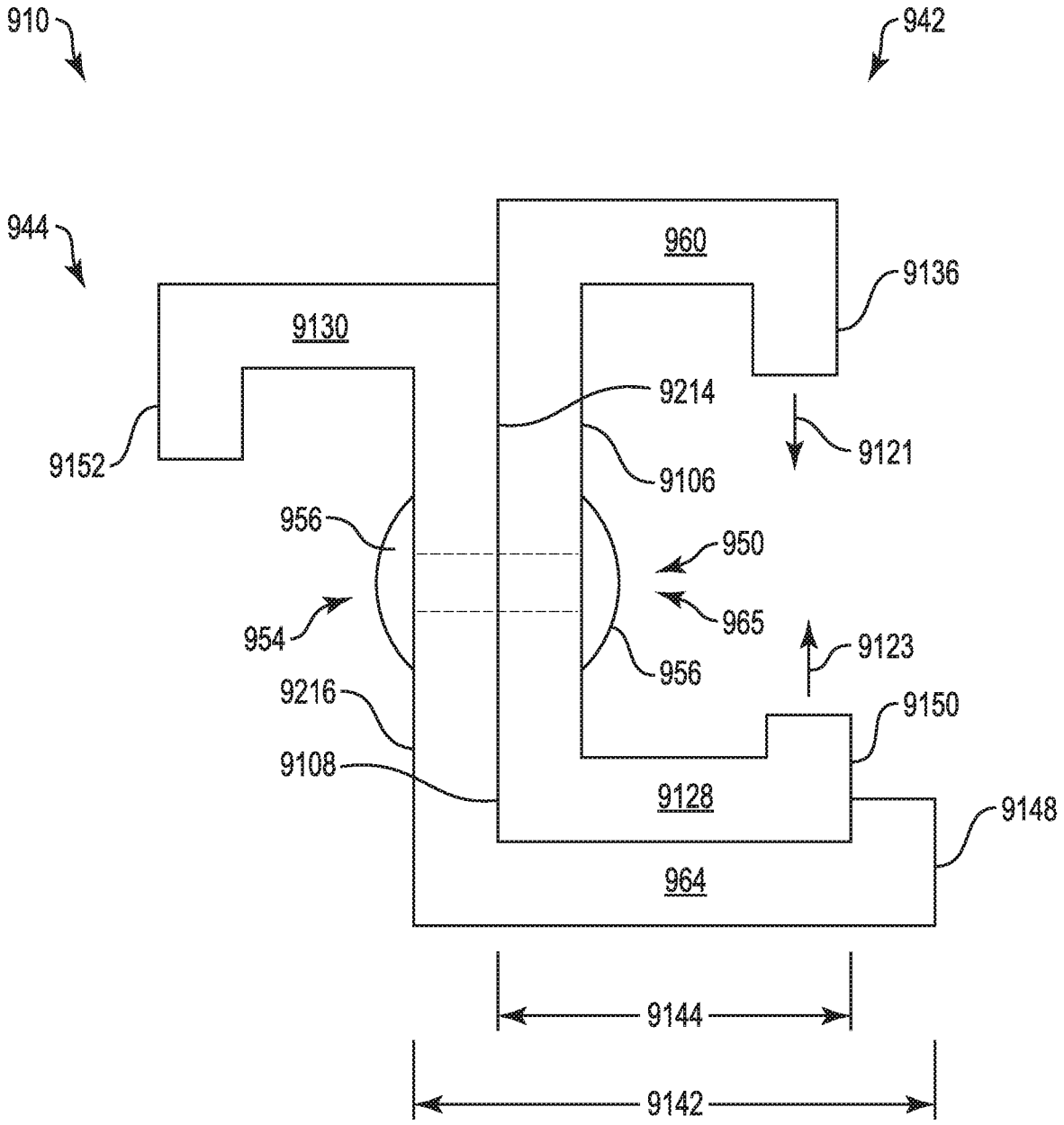
FIGS. 9A-9B illustrate a portion of the jointed member according to the present disclosure.

Referring now to FIG. 9A, there is illustrated a cross sectional view of the jointed member 910 in its second predetermined state. In FIG. 9A, first elongate section 942 opposes the second elongate section 944 and the jointed member 910 is considered to be in the second predetermined state.

As illustrated in FIG. 9A, when the jointed member 910 is in the second predetermined state the third abutment member 9128 abuts the second abutment member 964. The contact between the third abutment member 9128 and the second abutment member 964 may help to maintain the jointed member 910 in the second predetermined state. Because the third abutment member 9128 abuts the second abutment member 964 in the second predetermined state, the second predetermined state may be considered in a stopped state. For the embodiment of FIG. 9A, the reinforcement section 9136 extends in the first direction 9121 and the reinforcement section 9150 extends in the second direction 9123 that is opposite of the first direction 9121.

For one or more embodiments, the width 9142 of the second abutment member 964 may have a value greater than the width 9144 of the third abutment member 9128. This greater width may help provide that in the second predetermined state the first elongate section 942 fits within (e.g., is nested into) a portion of the second elongate section 944.

As discussed herein the first oblong opening 950 and the second oblong opening 954 overlap to receive the fastener 956. Fastener 956 may pass through the first oblong opening 950 and the second opening 954 to connect the first elongate section 942 and the second elongate section 944. The fastener may have various cross sectional geometries including, but not limited to, a round cross sectional geometry, an oval cross sectional geometry, and a square cross sectional geometry. The fastener may be selected to best fit the first oblong opening and/or the second oblong opening. The first oblong opening 950 and the second opening 954 may be obround in shape.

For one or more embodiments, the fastener 956 may be integral with the first elongate section 942. For such embodiments, the first elongate section 942 does not include the first oblong opening. For these embodiments the fastener moves relative the second oblong opening 954 as the jointed member 910 transitions from the first predetermined state to the second predetermined state. For these embodiments the fastener 956 moves laterally within the second oblong opening 954.

For one or more embodiments, the fastener 956 may be integral with the second elongate section 944. For such embodiments, the second elongate section does not include the first oblong opening. For these embodiments the fastener moves relative the first oblong opening 950 as the jointed member 910 transitions from the first predetermined state to the second predetermined state. For these embodiments the fastener 956 moves laterally within the first oblong opening 950.

Figure 9B:
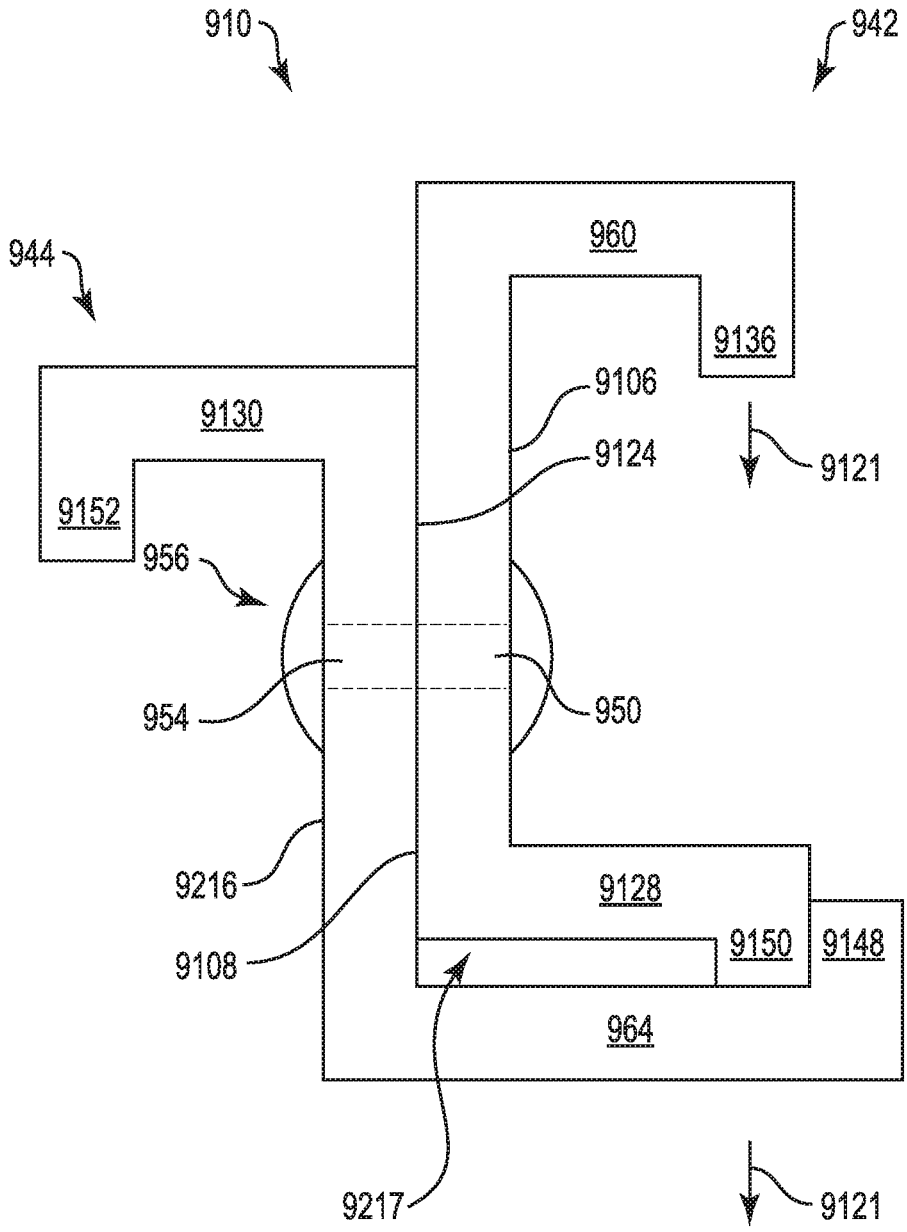

FIG. 9B illustrates a portion of the jointed member 910 according to one or more embodiments of the present disclosure. FIG. 9B illustrates the jointed member 910 taken from the same perspective as FIG. 9A. However, for the embodiment of FIG. 9B the reinforcement section 9136 extends in the first direction 9121 and the reinforcement section 9150 also extends in the first direction 9121. In FIG. 9B, first elongate section 942 opposes the second elongate section 944 and the jointed member 910 is considered to be in the second predetermined state.

For the one or more embodiments, a surface of the second abutment member 964, a surface of the third abutment member 9128, a surface of the reinforcement section 9150, and the first major surface 9108 define an opening 9217. The opening 9217 may help provide a space for a component (e.g., screws) that protrudes from the second elongate section 944 into the opening 9217.

As discussed the jointed member may employed for a reversibly foldable freight container, as is discussed herein. The jointed member, as disclosed herein, may however be employed for various applications that include a transition from an unfolded state to a folded state without expanding beyond the defined maximum length of the jointed member in the unfolded state, while neither bowing or damaging the jointed member, a pivotal connection (e.g., a hinge) or a structure, (as discussed herein), of the container.

Embodiments of the present disclosure provide reversibly foldable structures. The reversibly foldable structures, as discussed herein, include the jointed member as disclosed herein. As such, these reversibly foldable structures may transition from an unfolded state to a folded state without expanding the reversibly foldable structure beyond the defined maximum length of the jointed member in the unfolded state. As discussed, the jointed member includes the first elongate section having the surface defining the first oblong opening, the second elongate section having the surface defining the second oblong opening, and the fastener passing through the first oblong opening and the second opening to connect the first elongate section and the second elongate section, where the first oblong opening and the second oblong opening move relative each other and the fastener as the jointed member transitions from the first predetermined state having the minimum overlap of the first oblong opening and the second oblong opening towards the second predetermined state.

Figure 10A:
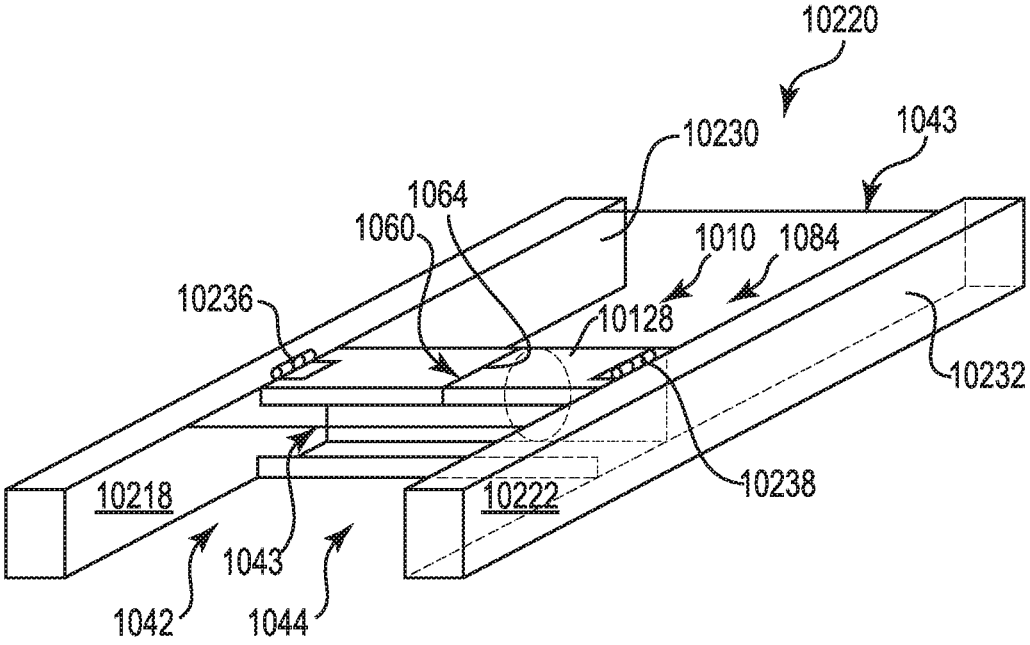
FIGS. 10A-10C illustrate a reversibly foldable structure according to the present disclosure.

FIG. 10A illustrates a reversibly foldable structure 10220 according to the present disclosure. The reversibly foldable structure 10220 includes a first longitudinal member 10218 and a second longitudinal member 10222. The reversibly foldable structure 10220 includes the jointed member 1010, as disclosed herein. The jointed member 1010 may be located between the first longitudinal member 10218 and the second longitudinal member 10222. The reversibly foldable structure 10220 can also include a structure 1043, as discussed herein. FIG. 10A illustrates the jointed member 1010 in the first predetermined state. As the jointed member 1010 is in the first predetermined state, i.e. the unfolded state, the reversibly foldable structure 10220 is in an unfolded state. The jointed member 1010 may be connected to the first longitudinal member 10218 by a first hinge 10236 and connected to the second longitudinal member 10220 by a second hinge 10238. As illustrated in FIG. 10A, in the first predetermined state the first abutment member 1060 abuts the second abutment member 1064 and the first elongate section 1042 abuts the first longitudinal member 10218 and the second elongate section 1044 abuts the second longitudinal member 10220.

For one or more embodiments, the reversibly foldable structure can include a plurality of the jointed members, as disclosed herein. Each of the plurality of the jointed members may be located between the first longitudinal member and the second longitudinal member. Each of the plurality of the jointed members may be connected to the first longitudinal member by a first respective hinge and connected to the second longitudinal member by a second respective hinge.

Figure 10B:
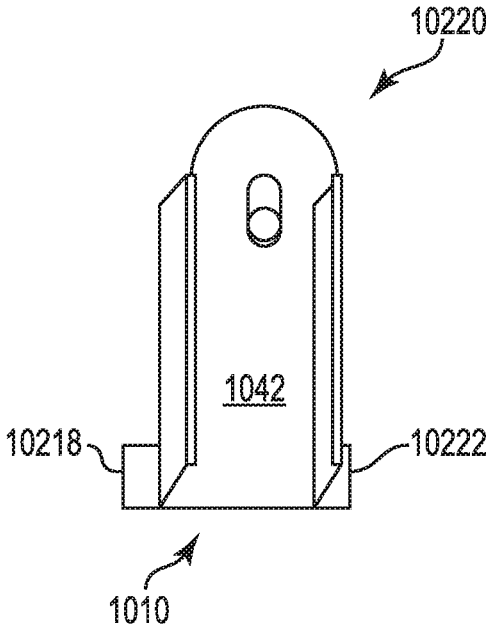

FIG. 10B illustrates a reversibly foldable structure according to one or more embodiments of the present disclosure. FIG. 10B illustrates the jointed member 1010 in the second predetermined state. As the jointed member 1010 is in the second predetermined state, the reversibly foldable structure 10220 is in the folded state. The reversibly foldable structure may transition from the folded state back to the unfolded state, and is thus reversibly foldable.

Figure 10C:
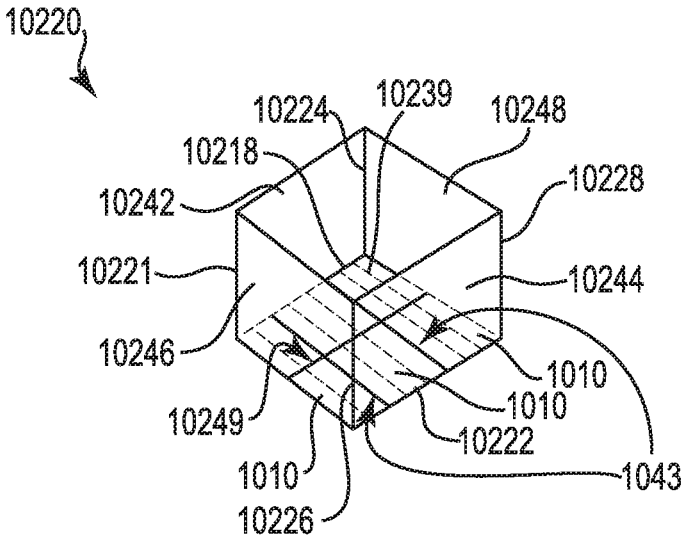

FIG. 10C illustrates a reversibly foldable structure according to one or more embodiments of the present disclosure. In the embodiment illustrated in FIG. 10C the reversibly foldable structure 10220 includes a first vertical support member 10221, a second vertical support member 10224, a third vertical support member 10226, and a fourth vertical support member 10228. For differing applications these vertical support members may have various values of length, width, and height. Additionally, these vertical support members may have various cross-sectional geometries. For example these vertical support members may have a rectangular cross-sectional geometry, a circular cross-sectional geometry, or a combination thereof.

The reversibly foldable structure 10220 in FIG. 10C has the first longitudinal member 10218 located between the first vertical support member 10221 and the second vertical support member 10224, and the second longitudinal member 10222 located between the third vertical support member 10226 and the fourth vertical support member 10228. For differing applications these longitudinal members may have various values of length, width, and height. Additionally, these longitudinal members may have various cross-sectional geometries. For example these longitudinal members may have a rectangular cross-sectional geometry, a circular cross-sectional geometry, or a combination thereof.

The reversibly foldable structure 10220 can also include a first wall element 10242 connected to the first vertical support member 10221 and the second vertical support member 10224, and a second wall element 10244 connected to the third vertical support member 10226 and the forth vertical support member 10228. The reversibly foldable structure 10220 can also include a first end panel 10246 connected to the first vertical support member 10221 and the third vertical support member 10224. For one or more embodiments, the reversibly foldable structure 10220 can include a second end panel 10248 connected to the second vertical support member 10224 and the fourth vertical support member 10228.

The reversibly foldable structure 10220 also includes a floor component 10239. The floor component may be connected to the jointed member 1010, e.g. the floor component 10239 may be connected to the first abutment member and/or the second abutment member, as discussed herein. As illustrated, the floor component 10239 can also include a joint 10249 that aligns with the interface of the first and second abutment members of the jointed member 1010. In this way as the jointed member 1010 folds into the volume defined by the reversibly foldable structure 10220 so will the floor component 10239.

The first end panel 10246 and the second end panel 10248 can have a number of different configurations. For example, the first end panel 10246 and the second end panel 10248 can be made of a flexible material that can fold as the reversibly foldable structure 10220 folds from the unfolded state towards the folded state. Examples of such flexible material include, but are not limited to, fabric (woven or knit), polymers, reinforced polymers, and combinations thereof. The first end panel 10246 and the second end panel 10248 can also be formed of rigid segments united by joints that extend longitudinally with the longitudinal axes of the vertical support members 10221, 10224, 10226 and 10228. As the reversibly foldable structure 10222 folds and unfolds, the joints can allow at least some of the rigid segments to move so as to accommodate the motion of the jointed member 1010 and the reversibly foldable structure 10220.

In an alternative embodiment, the first end panel 10246, the second end panel 10248, and/or the floor component 10239 may be detached from the reversibly foldable structure 10220 prior to the reversibly foldable structure 10220 transitioning from the unfolded state to the folded state.

Embodiments of the present disclosure also provide for a reversibly foldable freight containers, as discussed herein. For one or more embodiments, the reversibly foldable freight containers can conform to the International Organization for Standardization (ISO) standard. For example, the reversibly foldable freight containers, as disclosed herein, may conform to ISO standard 688 and ISO standard 1496 (and the amendments to ISO standard 1496), each incorporated herein by reference. As discussed herein, the commercial standards for freight containers are set by the ISO. The ISO sets the commercial standards for almost every aspect of the freight container. Such commercial standards include, but are not limited to, the design, dimensions, dimensional tolerances, freight transport, ratings, weight (mass), center of gravity, load capacity, hoisting tests, symbols, marking, position, stacking tests, weather resistance, and mechanical testing of the freight container, among others.

The reversibly foldable freight containers, as discussed herein, can include a plurality of the jointed members, as disclosed herein. As such, these reversibly foldable freight containers may transition from an unfolded state to a folded state without expanding the reversibly foldable structure beyond the unfolded state (e.g., the maximum defined width, as discussed herein). The reversibly foldable freight containers may transition from the folded state back to the unfolded state, and are thus reversibly foldable.

Figure 11:
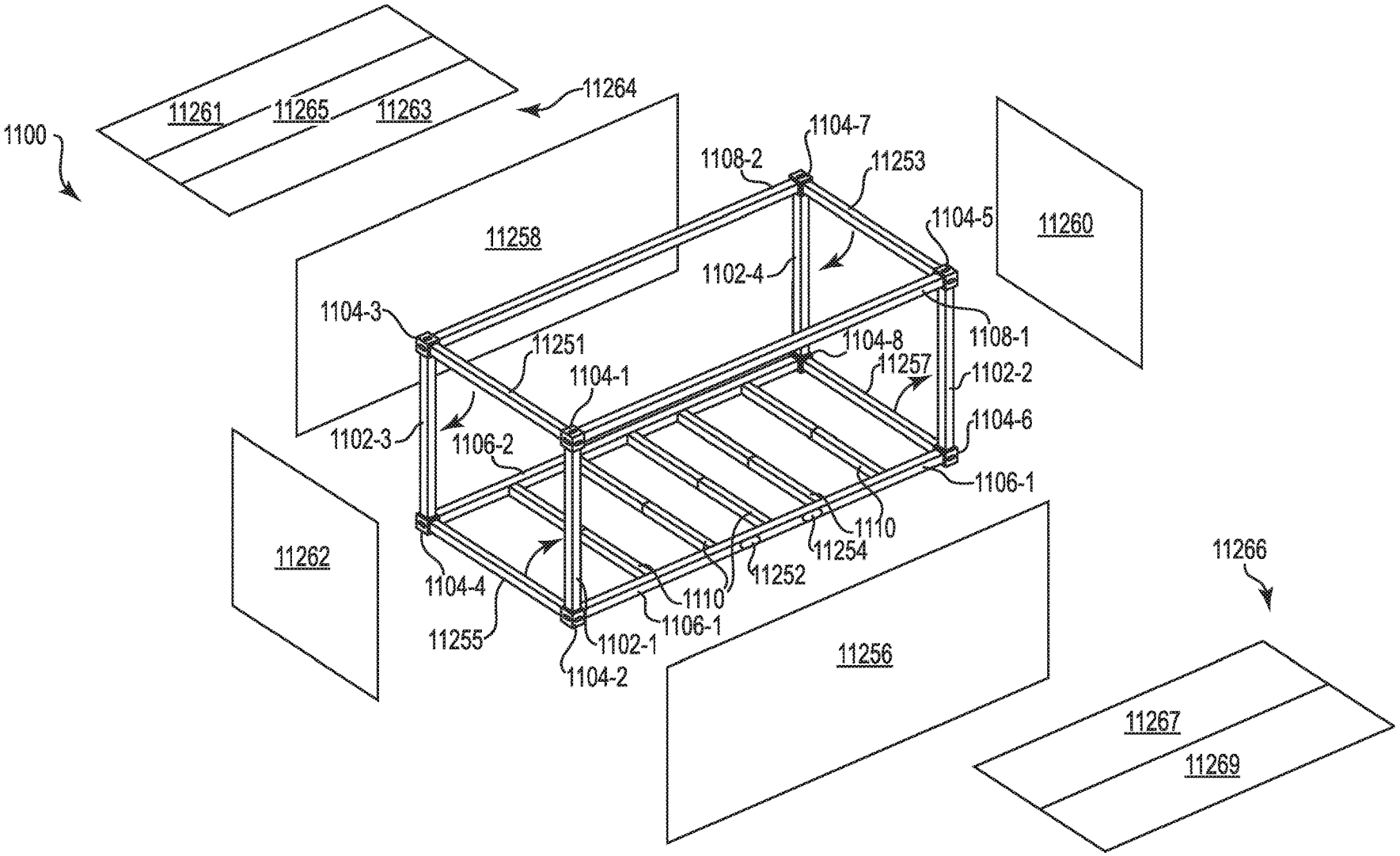
FIG. 11 illustrates an exploded view of a reversibly foldable freight container according to one or more embodiments of the present disclosure.

FIG. 11 illustrates an exploded view of a reversibly foldable freight container 1100 according to one or more embodiments of the present disclosure. FIG. 11 includes a number of elements as discussed with FIGS. 1A-1B. For one or more embodiments, the reversibly foldable freight container 1100 can include a first forklift pocket 11252 and a second forklift pocket 11254. As illustrated in FIG. 11, the first forklift pocket 11252 and the second forklift pocket 11254 may each be a respective opening in the first and second bottom side rails 1106-1 and 1106-2.

The reversibly foldable freight container 1100 further includes a first header 11251 and a second header 11253. When the reversibly foldable freight container is in the unfolded state, the first header 11251 and the second header 11253 may each be located between the first upper side rail 1108-1 and the second upper side rail 1108-2 (e.g., substantially parallel to the jointed members 1110 in the first predetermined state).

The first header 11251 is releasably connected (e.g., via a bolt or a fastener) to corner fitting 1104-1 that contacts a first of the upper side rails 1108 and is pivotally connected to corner fitting 1104-3 that contacts a second of the upper side rails 1108-2. Likewise, the second header 11253 is releasably connected to corner fitting 1104-5 that contacts a first of the upper side rails 1108-1 and is pivotally connected to corner fitting 1104-7 that contacts a second of the upper side rails 1108-2. The bolt or fastener that releasably connects the first header may be removed to allow the first header 11251 to pivot substantially ninety degrees so that the first header 11251 is adjacent (e.g., is substantially parallel to) the load bearing vertical support member 1102-3 that contacts the corner fitting to which the first header is pivotally connected. Likewise, the bolt or fastener that releasably connects the second header 11253 may be removed to allow the second header 11253 to pivot substantially ninety degrees so that the second header 11253 is adjacent (e.g., is substantially parallel to) the load bearing vertical support member 1102-4 that contacts the corner fitting to which the second header 11253 is pivotally connected.

For one or more embodiments, the reversibly foldable freight container 1100 may include a first sill 11255 and a second sill 11257. When the reversibly foldable freight container is in the unfolded state, the first sill 11255 and the second sill 11257 may each be located between the first bottom side rail 1106-1 and the second bottom side rail 1106-2 (e.g., substantially parallel to the jointed members 1110 in the first predetermined state).

The first sill 11255 is releasably connected (e.g., via a bolt or a fastener) to corner fitting 1104-4 that contacts a first of the bottom side rails 1106-2 and is pivotally connected to corner fitting 1104-2 that contacts a second of the bottom side rails 1106-1. Likewise, the second sill 11257 is releasably connected to corner fitting 1104-8 that contacts a first of the bottom side rails 1106-2 and is pivotally connected corner fitting 1104-6 that contacts a second of the bottom side rails 1106-1. The bolt or fastener that releasably connects the first sill 11255 may be removed to allow the first sill 11255 to pivot substantially ninety degrees so that the first sill 11255 is adjacent (e.g., is substantially parallel to) the load bearing vertical support member 1102-1 that contacts the corner fitting to which the first sill is pivotally connected. Likewise, the bolt or fastener that releasably connects the second sill 11257 may be removed to allow the second sill 11257 to pivot substantially ninety degrees so that the second sill 11257 is adjacent (e.g., is substantially parallel to) the load bearing vertical support member 1102-2 that contacts the corner fitting to which the second sill is pivotally connected.

For one or more embodiments, the reversibly foldable freight container 1100 may include a first sidewall panel 11256, a second sidewall panel 11258, an endwall panel 11260, a door 11262, and a roof 11264. The first sidewall panel 11256 may be connected to the first load bearing vertical support member 1102-1 and the second load bearing vertical support member 1102-2. The second sidewall panel 11258 may be connected to the third load bearing vertical support member 1102-3 and the fourth load bearing vertical support member 1102-4. The endwall panel 11260 may be connected to the second load bearing vertical support member 1102-2 and the fourth load bearing vertical support member 1102-4. The door 11262 may be connected to the first load bearing vertical support member 1102-1 and the third load bearing vertical support member 1102-3.

The roof 11264 may include a first roof panel section 11261, a second roof panel section 11263, and a third roof panel section 11265. The roof 11264 is reversibly foldable, as discussed herein. For example, as the joined member 1110 folds into the reversibly foldable freight container 1100, the roof panel sections 11261, 11263, 11265 may also fold into the reversibly foldable freight container 1100. The roof 11264 may be connected to the first upper side rail 1108-1 and the second upper side rail 1108-2.

The first roof panel section 11261 may be connected to the third roof panel section 11265 by one or more hinges. For one or more embodiments, the first roof panel section 11261 may be connected to the third roof panel section 11265 by a flexure bearing (e.g., a living hinge). The second roof panel section 11263 may be connected to the third roof panel section 11265 by one or more hinges. For one or more embodiments, the second roof panel section 11263 may be connected to the third roof panel section 11265 by a flexure bearing (e.g., a living hinge).

In the unfolded state, each of the roof panel sections 11261, 11263, 11265 may be substantially parallel to one another (e.g., each roof panel section may be substantially parallel to the jointed members 1120 in the first predetermined state). In the unfolded state the roof may be referred to as flat. In the folded state, roof panel sections 11261, 11263 may be substantially parallel to one another, while each of the roof panel sections 11261, 11263 is substantially perpendicular to the roof panel section 11265. In the folded state, the roof may be referred to as a partial rectangle.

For one or more embodiments, the reversibly foldable freight container includes a flooring surface 11266. The flooring surface may include a first floor section 11267 and a second floor section 11269. The flooring surface 11266 is reversibly foldable, as discussed herein. For example, as the joined member 1110 folds into the reversibly foldable freight container 1100, the floor sections 11267, 11269 may also fold into the reversibly foldable freight container 1100. The flooring surface 11266 may be connected to a number the plurality of jointed members 1110 (e.g., adjacent the first bottom side rail 1106-1 and/or the second bottom side rail 1106-2).

Figure 12:
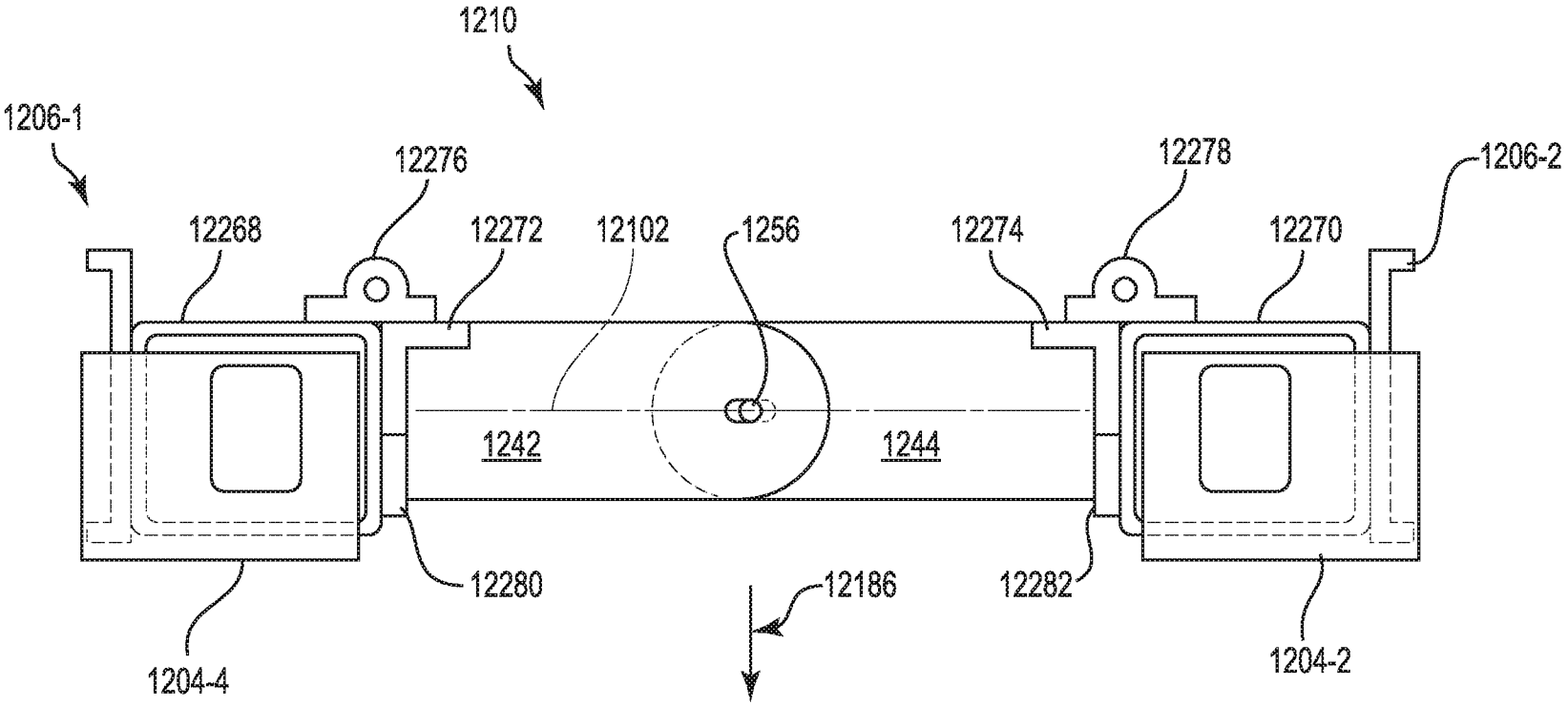
FIG. 12 illustrates a portion of a reversibly foldable freight container according to the present disclosure.

FIG. 12 illustrates a portion of a reversibly foldable freight container according to one or more embodiments of the present disclosure. The reversibly foldable freight container includes jointed member 1210 that may or may not include the abutment members, as discussed herein. The jointed member 1210 shown in FIG. 12 is an example that does not include the abutment members.

For one or more embodiments, the reversibly foldable freight container includes the first bottom side rail 1206-1. In FIG. 12, the first bottom side rail 1206-1 includes a first polygonal tube 12268 connected thereto. Similarly, the reversibly foldable freight container includes the second bottom side rail 1206-2. In FIG. 12, the second bottom side rail 1206-1 includes a second polygonal tube 12270. For one or more embodiments, the first polygonal tube 12268 spans a length of the first bottom side rail 1206-1 and the second polygonal tube 12270 spans a length of the second bottom side rail 1206-2. For example, the first polygonal tube 12268 may contact corner fitting 1204-4 and/or another corner fitting such 1204-8, which is not shown in FIG. 12. Similarly, the second polygonal tube 12270 may contact corner fitting 1204-2 and/or another corner fitting, such 1204-6, which is not shown in FIG. 12.

While the first polygonal tube and the second polygonal tube are discussed herein, there may be a polygonal tube connected to each of the longitudinal members of the reversibly foldable freight container. For example, while the first polygonal tube is connected to the first bottom side rail and the second polygonal tube is connected to the second bottom side rail, there may be a third polygonal tube connected to the first upper side rail, and/or a fourth polygonal tube connected to the second upper side rail. Each of the polygonal tubes may be similarly described, while differing in their respective connections and/or contacts.

The first polygonal tube may have a rectangular cross section, when taken from a plane that is parallel to and includes the longitudinal axis 12102 of the first elongate section 1242 when the jointed member is in the first predetermined state. For one or more embodiments, the rectangular cross section is substantially square. The polygonal shape of the polygonal tubes discussed herein may help to nullify a rotational force (e.g., upon one or more of the jointed members) that may be present due to contents within the reversibly foldable freight container.

For one or more embodiments, the reversibly foldable freight container may include a first angle member 12272. The first angle member may be connected to a number of the first elongate sections 1242. For one or more embodiments, the reversibly foldable freight container may include a second angle member 12274. The second angle member may be connected to a number of the second elongate sections 1244.

For one or more embodiments, the angle members do not prevent forklift forks from engaging the reversibly foldable freight container. For embodiments including one or more of the forklift pockets, as discussed herein, the reversibly foldable freight container may include a plurality of angle members running along a longitudinal member of the reversibly foldable freight container. For example, embodiments may include one, two, three, or more angle members running along a longitudinal member (e.g., the first lower longitudinal member and/or the second lower longitudinal member).

For one or more embodiments, the reversibly foldable freight container may include a first hinge 12276 that contacts the first polygonal tube 12268 and the first angle member 122672. For one or more embodiments, the reversibly foldable freight container may include a second hinge 12278 that contacts the second polygonal tube 12270 and the first angle member 12274. While the first hinge and the second hinge are discussed herein, embodiments are not intended to be limited to these two hinges.

For one or more embodiments, the reversibly foldable freight container may include a first stop member 12280 attached to the first polygonal tube 12268 and a second stop member 12282 attached to the second polygonal tube 12270. The first stop member and second stop member may span the length of the first polygonal tube and the second polygonal tube, respectively.

As illustrated in FIG. 12, in the first predetermined state the first elongate section 1242 abuts the first stop member 12280 and the second elongate section 1244 abuts the second stop member 103282. Additionally, in the first predetermined state, the first angle member 12272 abuts the first polygonal tube 12268 and the first stop member 12280. Similarly, in the first predetermined state, the second angle member 12274 abuts the second polygonal tube 12270 and the second stop member 12282. The stop members may further help provide that the jointed member 1210 is non-moveable in the non-moveable direction 12186. Additionally, the stop members may help reduce a force applied to the hinges (e.g., the first hinge, the second hinge, etc.).

As discussed the reversibly foldable freight containers transition from the unfolded state to the folded state without expanding the container beyond the unfolded state (e.g., the maximum defined width, as discussed herein). In the unfolded state the reversibly foldable freight containers may be considered to a maximum width (e.g. an unfolded width). In the folded state the reversibly foldable freight containers may have a width that is less than 60 percent of the maximum width. For example, in the folded state the reversibly foldable freight containers may have a width that is 50 percent of the maximum width, 40 percent of the maximum width, 30 percent of the maximum width, 25 percent of the maximum width, or 20 percent of the maximum width. In the example where the reversibly foldable freight container has a width, in the folded state, which is 25 percent of the maximum width, four folded reversibly foldable freight containers may be stored in the space of one non-folded container.

What is claimed:

1. A reversibly foldable structure comprising:

a first longitudinal member;

a second longitudinal member; and a jointed member located between the first longitudinal member and the second longitudinal member, where the jointed member includes a first elongate section having a surface defining a first oblong opening, a second elongate section having a surface defining a second oblong opening, and a fastener passing through the first oblong opening and the second opening to connect the first elongate section and the second elongate section, where the first oblong opening and the second oblong opening move relative each other and the fastener as the jointed member transitions from a first predetermined state having a minimum overlap of the first oblong opening and the second oblong opening towards a second predetermined state having a maximum overlap of the first oblong opening and the second oblong opening.

2. The reversibly foldable structure of claim 1, including a first vertical support member, a second vertical support member, a third vertical support member, and a fourth vertical support member, the first longitudinal member located between the first vertical support member and the second vertical support member, and the second longitudinal member located between the third vertical support member and the fourth vertical support member.

3. The reversibly foldable structure of claim 1, where the first predetermined state the first elongate section abuts the first longitudinal member and the second elongate section abuts the second longitudinal member.

4. The reversibly foldable structure of claim 1, where the first elongate section includes a first abutment member extending in a first direction and a third abutment member extending in the first direction and the second elongate section includes a second abutment member extending in the first direction and an adjunct member extending in a second direction such that in the first predetermined state the first abutment member abuts the second abutment member.

5. The reversibly foldable structure of claim 4, where the third abutment member abuts the second abutment member in the second predetermined state.

6. The reversibly foldable structure of claim 4, where the first abutment member includes a first reinforcement section extending in a first direction and the third abutment member includes a second reinforcement section extending in the first direction.

7. The reversibly foldable structure of claim 4, where the first abutment member and the second abutment member extend in the first direction when the reversibly foldable structure is in the first predetermined state.

* * * * *